US008640363B2

(12) United States Patent
Hsu

(10) Patent No.: US 8,640,363 B2
(45) Date of Patent: Feb. 4, 2014

(54) ARTICLE OF FOOTWEAR WITH EMBEDDED ORTHOTIC DEVICES

(71) Applicant: Henry Hsu, Torrance, CA (US)

(72) Inventor: Henry Hsu, Torrance, CA (US)

( * ) Notice: Subject to any disclaimer, the term of this patent is extended or adjusted under 35 U.S.C. 154(b) by 0 days.

(21) Appl. No.: 13/847,281

(22) Filed: Mar. 19, 2013

(65) Prior Publication Data

US 2013/0205620 A1 Aug. 15, 2013

(51) Int. Cl.

| | |
|---|---|
| ***A43B 7/14*** | (2006.01) |
| ***A43B 3/24*** | (2006.01) |
| ***A43B 3/12*** | (2006.01) |
| ***A61F 5/14*** | (2006.01) |

(52) U.S. Cl.
USPC ..... 36/145; 36/101; 36/11.5; 36/148; 36/76 R

(58) Field of Classification Search
USPC ..... 36/145, 101, 11.5, 148, 76 R, 76 C, 107, 36/103, 152, 166, 167, 169, 171, 173–179, 36/180–182
See application file for complete search history.

(56) References Cited

U.S. PATENT DOCUMENTS

| | | | | |
|---|---|---|---|---|
| 2,897,611 | A | 8/1959 | Schaller | |
| 4,571,857 | A | 2/1986 | Castellanos | |
| 5,247,742 | A | 9/1993 | Kilgore et al. | |
| 5,311,680 | A | 5/1994 | Comparetto | |
| 5,327,663 | A | 7/1994 | Pryce | |
| 5,528,842 | A * | 6/1996 | Ricci et al. | 36/27 |
| 6,212,795 | B1 * | 4/2001 | Nakabe et al. | 36/25 R |
| 6,345,455 | B1 | 2/2002 | Greer, Jr. et al. | |
| 6,763,615 | B2 * | 7/2004 | Mitsui et al. | 36/91 |
| 6,817,112 | B2 * | 11/2004 | Berger et al. | 36/3 B |
| 7,111,415 | B2 | 9/2006 | Hockerson | |
| 7,533,477 | B2 | 5/2009 | Goodwin et al. | |
| 7,823,299 | B1 | 11/2010 | Brigham | |
| 7,980,006 | B2 | 7/2011 | Aveni et al. | |
| 8,042,287 | B2 | 10/2011 | Reinhardt et al. | |
| 8,074,377 | B2 * | 12/2011 | Nishiwaki et al. | 36/25 R |
| 8,225,534 | B2 | 7/2012 | Mueller et al. | |
| 2004/0064974 | A1 | 4/2004 | Schuster | |
| 2005/0235526 | A1 | 10/2005 | Kim | |
| 2008/0141562 | A1 | 6/2008 | Peveto | |
| 2008/0168682 | A1 * | 7/2008 | Le | 36/101 |
| 2008/0216360 | A1 | 9/2008 | Schenone | |
| 2008/0229624 | A1 | 9/2008 | Mueller | |
| 2008/0256830 | A1 | 10/2008 | Frederick | |
| 2009/0126232 | A1 | 5/2009 | Cholewa | |
| 2010/0018077 | A1 | 1/2010 | Marone | |
| 2010/0307025 | A1 * | 12/2010 | Truelsen et al. | 36/28 |

* cited by examiner

*Primary Examiner* — Ted Kavanaugh
(74) *Attorney, Agent, or Firm* — Kenneth L. Green

(57) ABSTRACT

Footwear including an integrated orthotics system provides support with progressive resistance in pronation and supenation motions of the foot during a gait cycle. The orthotics system includes an orthotic device between the mid-sole and the outsole and extend from the rear foot's calcaneus region to the forefoot region where the phalanges and metatarsal joints meets. The orthotic device includes contours mimicking a foot sole shape in an unloaded state. The orthotic system may also include a secondary external orthotic device embedded underneath the outsole to provide control in the mid foot region to achieve progressive compression resistance in the mid foot arch zones. The secondary device may be customizable to achieve a wide range of resistance level needed in mid foot compression by the wearer. The orthotics combined with the midsole and outsole provide progressive mid foot compression resistance and directional flex associated with pronatory motions of the foot.

22 Claims, 22 Drawing Sheets

ARTICLE OF FOOTWEAR WITH EMBEDDED ORTHOTIC DEVICES

BACKGROUND OF THE INVENTION

This invention relates to footwear and in particular to footwear with embedded orthotic devices.

The outsole design in known sports and leisure activity footwear serves as a flat, semi ridged platform to support and cushion the entire surface of the foot. The manufactures main focus are on cost and utilizing established manufacturing techniques to produce stylized differentiated designs between brands and model lines. The sole design offered in footwear today provides a generalized stationary cushioning bed for a foot's contours in insulating contact against the ground. While cushioning and support are addressed with the midsole inserts for arches and heel support, it is unable to fully and evenly support the full contours on the soles. The inability of footwear to fully support the foot by capturing contours of the soles hinders the outsole's ability to evenly distribute weight of the wearer's body across the entire sole surface. Furthermore, a stationary sole platform is not able to capture the foot's natural biomechanical movements and translate them into compression and directional flex motions onto the footwear. Due part in design and in manufacturing process, current production footwear are made to cushion and support the wearer's foot made by established methods of footwear construction. A new approach of constructing an outsole system to fully capture the foot's natural movements, and benefit a wearer by evenly supported the weight of the entire foot, is needed.

Typical constructions in most footwear outsole consists of three main components: 1) a semi flexible molded bottom outsole using urethane rubber to provide traction and protection of the foot; 2) a single density polyurethane foam added to the outsole to provide additional cushioning and support needs; and 3) a midsole or liner is then added on top of outsole to provide additional contoured cushioning against the flat foot bed surface. Flat layers of midsole and outsole are often used due to ease of manufacturing process as they can be die cut from flat sheet materials. However, the soles of feet have unique contours and structural load bearing zones like the heel and the forefoot. The cushioning needs of the foot may requires localized load bearing zones to provide a more adequate cushioning and support throughout different regions of the foot. The combination of molded outsole, midsole and liner can make the overall footwear feel stiff, rigid and insufficiently insulate the wearer's foot from the ground surface. Fused with multi layered upper construction adds to the overall footwear rigidity with boot like hardness.

Construction of a flat, rigid outsole and its inability to emulate the bottom contours of the foot hinders a foot's natural biomechanical movement in a gait cycle. Some midsole currently on the market are molded with mid foot arch contours to assist in supporting the mid foot, but they do not fully capture the mid foot arch surfaces. The midsole used only provide minimal medial arch support by vertical downward compression of the foam material used. While the full directional flex motions as the foot pronates and supenates during a gait cycle are not supported by the midsole insert. As weight is being distributed onto the foot, the pronatory and supenatory effects change the shapes of the foot to absorb the load. This range of motion is cushioned by midsole foam but not captured or enhanced by the footwear.

Over time the midsole and outsole foam material breaks down as (Ethylene Vinyl Acetate) EVA deteriorates and looses its rebound elasticity quickly. Foot pain and discomfort soon ensues. The result of incorrect and inadequately support from the footwear attributed by the flat and rigid outsole design creates many problems for the foot. The lack of mid foot arches support are a common problem causing pain and discomfort for the wearer. The lack of proper mid foot arch support may lead to over pronation as the cause of heel pain known as Plantar Fasciitis. Calluses, and Bunion are some of the other symptoms caused by over pronation. Without proper support of the mid foot, the heel and fore foot are tasked to bare the entire weight. This also attributes to the causes of heel, mid foot and forefoot discomfort and pain. As the soles of the footwear deteriorates over time and use, the wearer may find their foot with a shorter threshold to withstand pain and discomfort from the footwear.

As incorrect and inadequately support in the footwear causes pain and discomfort. Wearers seek relief from discomfort, and foot pain by purchasing foam or soft silicone gel insole inserts to provide additional cushioning for their feet. Using the inserts can create other problems as the original footwear is not designed for use with the unique shapes and contoured thickness of the inserts. This causes fit and comfort issues with the upper while raising the heel height on the lower outsole. In some cases, custom formed orthotics of ridged thermoplastics or composite inserts with custom formed mid foot arches are used for wearer's with chronic foot pains. Much like placing a brand new house on an existing foundation not designed to support the new house, the orthotic insert device is placed on top of the outsole while the bottom surfaces are not being fully supported. The orthotic inserts can not perform properly due to the lack of stable regionalized support needed to directly engage the ground plane through the outsole. Overly cushioning and supporting the foot with added insert devices may not address the need for footwear to flex and move with the natural biomechanical moments of the foot particularly in the mid foot arch region. While artificially raising the heel height can create instability for the heel to lose balance and slip off the inserts causing twist ankle injuries. A system of support is need which fully supports the regional load bearing zones of the foot.

The current production footwear outsole only serves as a flat stationary platform for the foot to rest on. A new system of flexible support is needed to cooperate the movements of the foot. This requires a completely redesigned sole system is needed to achieve comfort, support and enable the soles to move and flex with the foot. The ability for a footwear to flex with the biomechanical motions of the foot in a gait cycle requires the motions of pronation and supenation to be identified and quantified in order to translate into applicable flexing movements of the outsole system.

Human mobility consists of bi pedal movements defined as a gait cycle. During the gait cycle, the heel strikes the ground first, then the mid foot and forefoot rolls forward to establish contact to the ground. Weight then is shifted over the foot as the foot goes though a tri lateral motion called pronation. The movement of pronation and supenation consists of motions in three planes, the saginal plane, the frontal plane, and the horizontal plane. In the saginal plane, the fore foot rotates up as it pronates in dorsiflexion and down as it supenates in plantarflexion. In the frontal plane the foot rotates out as it pronates in inversion and rotates in as it supenates in eversion. In the horizontal plane, the foot pivots out as it pronates in adduction and pivots in as it supenates in abduction. Pronation can be seen as a spring like compression of the foot to absorb the weight of the body. While supenation is the rebound of the foot as it return to its original, unloaded state.

Different parts of the foot have unique cushioning and support needs driven by the bone structures and biomechanical motion of the foot. The rear of the foot, known as the heel, contains the Calcaneus bone structure which serves as the main load bearing base for the foot when in motion or at rest. The heel also provides the initial landing strike to the ground during a gait cycle as part of the bi pedal movement. As the heel strikes the ground the heels may be subjected to the entire weight of the body. During running, jumping and other athletic sports activities, the heel strike may far exceed one's own body weight. Thus a denser cradle made to reflect the contours of the heel can better protect and distribute energy more evenly across the heel zone.

The mid foot consists of a key stone like structure with the Navicular, Cuboids, and Cuneiform bones. It also houses the Tarsometatarsal joint which serves as a connection to the first though fifth Metatarsal bones. Mid foot is also know as a medial and lateral arches of the foot. The mid foot joint structure serves as a compressible arch to allow flex as part of the suspension system of the foot to absorb the weight of the body. Due to the biomechanical nature of feet, support for the mid foot in flex of medial and lateral arch is a much needed element to incorporate into the outsole design.

The forefoot is located at the ends of the metatarsal bone as it connects to the phalanges, also known as toes. At the joints of the phalanges and the first Metatarsal joint lies the Sesamoid bone. The Sesamoid bone with the ends of the first Metatarsal, are also known as the ball of the foot. The forefoot also expands and pivots outward in adduction as part of pronatory motions. This motion can be attributed as a byproduct of compression in the mid foot. Thus, a need exists for an orthotics sole system which allows for this movement as part of flexing motion. The forefoot further serves as another load bearing zone, as the weight of the body is mainly distributed onto the fore foot and the foot's heel region. The forefoot is also responsible for propulsion as the foot rolls forward to begin the pushing off the stage of the gait cycle.

In the footwear upper design, thong type sandals are among the most popular styles on the market. This popularity is due to comfort and the simplistic nature of its design. While it is easy to slip in and out of the thong style sandal, the length of the straps are not adjustable. Due to lose fitting straps, the wearer often has to consciously maneuver their toes and forefoot to keep the sandals on and in place as the heel may shift from left to right. The problem is compounded as straps and sole material gets worn and stretched out. To achieve a secured and proper fit for the foot, a device is needed to easily adjust the length of the straps.

The toe loop in sandals are typically made with thin and flexible woven materials. Located between the toes or phalanges of the first and second metatarsal, the loops are often the source of discomfort. It can be difficult to keep the forefoot in position with the footwear as loose materials are used to connect the straps to the outsole which allows the forefoot to slide from side. A semi ridged toe post device is needed to keep the foot in position with the outsole.

Most common footwear upper construction utilizes lacing to achieve proper fit to footwear uppers as methods of securing the foot. Since most footwear upper construction utilizes non stretchable materials, lacing and/or elastic material is used to achieve proper fit and secure the footwear to the foot. The foot is first strapped in, then presses down into the sole as lacing is tightened over to secure the foot. This method of adjustment no doubt creates uneven pressure points along the entire fore and mid foot in static or in motion. It may also cause binding on the upper because as the forefoot bends, it creates high tension areas as the upper is unable to stretch and accommodate the movement of the foot in pushing off stage of the gait cycle. Due to unique foot shapes, a better way of securing the foot to the footwear is needed to address fit, comfort, and more evenly distribute pressure across the foot.

Sandals at times need to be stored vertically as they are often washed and dried. At the beach they are carried by hand as wearer walks in sand and in surf. A better way of carrying and storing the sandals with a feature to combine both left and right foot when it's not in use is needed.

SUMMARY OF THE INVENTION

The present invention addresses the above and other needs by providing an article of footwear with an integrated orthotics sole system designed to provide support and progressive resistance for the foot's compression motions known as pronation and rebound motions known as supenation. The flexing movement of the foot is captured, supported, and enhanced by the orthotics sole system. This enables the soles of the footwear to flex and move together as one with the wearer's foot in providing a more even distribution of weight across the entire sole. Additional design features are also represented in this footwear invention to enhance comfort, fit, and utilities of the footwear.

In accordance with one aspect of the invention, there is provided a more ergonomically designed outsole system which can fully hug the bottom contours of the foot to captures all the sole's contours in providing support and progressive resistance in the mid foot region. The compression motions in the mid foot region known as pronation and rebound motions known as supenation should be fully supported. Benefits can be gained by requiring the outsole to flex and bend with the natural movement of the foot. This supportive suspension device will more evenly distribute the body weight by relieving the heel and forefoot zone from supporting the majority of the weight. Spreading the load across the entire sole surface still allows flexing as part of the natural suspension motion of the foot. The ability for a footwear to flex with the biomechanical motions of the foot in a gait cycle requires the motions of pronation and supenation to be identified and quantified in order to translate into applicable flexing movements of the outsole system.

In accordance with a second aspect of the invention, there is provided footwear which utilizes the bio mechanical motions of the foot as a guide in designing a sole system to fully support the pronatory motions of the foot. The sole system design follows the deep contours and curvatures of the foot to provide support and ensures even distribution of weight across the entire sole surface. Integrated into the midsole and bottom outsole design, the high profile contours of the embedded orthotics system offers a spring like resistance for support and conforms with the pronation and supenation motion of the foot. The embedded orthotics device in the sole system acts like a leaf spring to dampen and evenly distribute weight across the natural flexing movement of the foot. When weight is shifted off the foot the orthotic outsole system rebounds back by returning the stored energy in helping the mid foot region to achieve supenation. In order to achieve progressive resistance in directional flex to fully support the weight of the mid foot region, a new type of sole system with an embedded orthotics device working in synchronization with the midsole and outsole design is needed.

In accordance with another aspect of the invention, there are provided several, multi functional components combined together to form a dynamic cushioning support system for the foot. In the preferred embodiment of the present invention the sole system may consists four main components: 1) a midsole layer formed with natural contours of the foot sole in an unloaded state; 2) an orthotic device embedded between the midsole and outsole to enable support of longitudinal and lateral directional flex in the mid foot contours, hereafter called an arch flex device; 3) a bottom outsole capturing the midsole, and the orthotic device to form a dynamic structure enabling multi directional flex with ground engaging features; and 4) a dampening flex control device attached to the bottom of the outsole's ground engaging features, hereafter called the secondary arch flex device. The four main components combine together to form a system of progressive resistance support and controlled directional flex with the pronatory motions of the foot.

In accordance with another aspect of the invention, there is provided a unique forefoot zone which may include a more flexible design as the phalanges bend and flex. It is important that the mid foot support and the and arch flex compression device do not interfere with the fore foot's ability to flex in the pushing off stage of the gait cycle.

In accordance with yet another aspect of the invention the midsole design of the footwear is formed with the natural contours of the foot in a suspended non loaded state. This design allows the midsole to achieve full contact with the bottom sole surfaces of the foot. The contours first conforms to the calcaneus heel with a semi spherical concave cup to surround the rear heel region. The heel cup surface then moves forward and rises on both medial and lateral sides of the foot to capture the full mid foot arch contours. The midsole surface then flattens out towards the forefoot region with a mild contoured surface. Using this method of capturing the unloaded contours ensures the equal and immediate support of the sole as weight begins to transfer to the sole system.

In accordance with still another aspect of the invention, there are provided longitudinally flex grooves are formed into the top surface of the midsole. The grooves are curved around the flexion points of medial and lateral arch to serve as functional living hinges for the deflection of medial and lateral arches as they compress in pronation.

In accordance with another aspect of the invention, there are provided midsole which is also the main cushioning layer for the foot as it is generally formed with the softest compound of the sole system. Underside of the midsole is formed with a relief surface of a second elevation to allow the arch flex device to be fully embedded within. This determines the thickness and hardness needed in the midsole to insulate the foot against the material differences of the orthotic device and the outsole. The orthotic device for supporting the mid foot can be installed within the relief surface of a second elevation formed as a cavity on the bottom surface of the midsole to fully embed the device into the midsole. Walls around the arch flex insert hides the insert and divides the outsole along its parting lines. Utilizing the softer compounds, thicker forefoot region can be formed onto the bottom surfaces of midsole to provide additional cushioning in critical weight distribution zones of the foot.

In accordance with another aspect of the invention, there is provided a heel region which can maximize cushioning by increasing compression travel with use of a localized heel block centered at the base of calcaneus. The heel block may extend downward into the outsole to gain compressible space. Material having different density than the midsole can be used in forming the heel block to provide additional resiliency needed in the heel region. A removed rear heel portion on the midsole exposes the rear heel cup portion of the arch flex device making it visible from the exterior of an assembled sole system. The removed portion of the midsole provides an empty compressible space to allow the bottom outsole heel lip to deflect up into the midsole. This deflection movement on the outer rearward edge of the heel can also aid in absorbing some initial heel strike force in a gait cycle. Formed slots are also included at the forefoot to allow passage of the upper straps.

In accordance with still another aspect of the invention, there is provided a sole system which may include at least one orthotic device which can be made from a variety of thermoplastics with thickness and hardness to reflect the resiliency needed in supporting the load of the foot. The top surface of the orthotic device can utilize the same contour surface projected down from the midsole's contoured shapes. The molded orthotic device may be referred to as the arch flex device. The arch flex device typically covers from the heel region to the mid foot region. The arch flex device contains a semi spherical cup in the heel region to fully protect and support the heel strike area. The rounded cup like design of the arch flex device cradles the heel calcaneus bone structure to ensure even distribution of the weight around the entire heel area.

In accordance with another aspect of the invention, there is provided a arch flex device described in the midsole contoured surfaces which utilizes the same highly raised medial arch surfaces and a modestly raised lateral arch surface to provide full contoured support in the mid foot region. The overall top surface of the arch flex device is of the same contour projected down from the midsole region it covers. The center heel region of the arch flex device can be formed with a through cavity to allow heel block from the midsole to protrude through. This enables the center heel to have an additional compressible height with the softer midsole material. The cavity also allows the heels to embed deeper into the heel cup for fuller support of the heel and mid foot.

In accordance with still another aspect of the invention, the amount of resistance needed can be tuned by adjusting the overall thickness and shore D material hardness used in forming the device. Additional through slots can be incorporated into the arch flex system to promote resistance in directional forefoot adduction flex. The path of the formed in through slots can follow the general flexion groove established by the midsole. This ensures the midsole and arch flex device bends and deflects in unison as one when assembled. Slots formed with open ends can be used in the forefoot region to promote independent phalanges flexion. The lateral groove formed into the forefoot region also aid the phalanges movement as the forefoot bends in the push off stage of the gait cycle. Slots can also be designed to provide the snap fit locking tabs feature in attaching with the bottom outsole and secondary arch flex device. The slot size may vary as it also contributes to the resistance level required in medial and lateral arch flexion. A docking feature formed onto the bottom of the arch flex device can provide a direct physical contact to the secondary arch flex device. This feature can directly transfer the mid foot load onto the secondary device. It may also serve as a point of adhesion for the thermoplastic formed arch flex device.

In accordance with another aspect of the invention, there is provided a bottom outsole designed as a base to incorporate all components for the sole system in this footwear invention. The bottom outsole serves as an engineered structure in providing initial contact points to engage the ground surfaces. It can capture the weight of the foot being applied to the midsole and arch flex device by providing a foundational structure formed with elements to support the mid foot region which initiates directional flex of the forefoot. The outsole can also be seen as an enabling hinge for the pronatory movements of the foot.

In accordance with another aspect of the invention, there are provided top surfaces of the outsole which can have a backing surface to provide full contact support for the arch flex device's bottom surface. The backing surface may contain locating slots of a raised second elevation to interlock with the corresponding through slots formed into the arch flex device. The locating slots secure the position of the arch flex device to the outsole and ensures both parts flex and move in unison. A cavity can be formed in the heel region from the top of the outsole with the same perimeter shape as the heel block. This allows the midsole heel block to be inserted through the heel cavity of the arch flex device's, then into the outsole's heel cavity, thus indexing and interlocking all three components from the heel region.

In accordance with still another aspect of the invention, there is provided a bottom of the outsole surface which utilizes the general contours of the foot similar to the contours used in the midsole design. The outsole structure can provide the first, second, and third stages of resistance needed in mid foot compression. The first stage of mid foot compression utilizes the space between the raised lateral arch and the ground plane as compressible zones. The downward force from the lateral sides of the foot are directly translated down through the midsole and arch flex device and onto the outsole's lateral arch. The resiliency of the combined sole system provides dampening for this motion.

In accordance with still another aspect of the invention, there is provided a second stage of mid foot compression which can utilize landing block features formed onto the bottom of the outsole. The landing blocks extend down to provide contact and a support structure to the ground plane. The landing blocks can be formed under the load bearing region to include the heel and mid foot region including the medial arch of the outsole. Therefore, the direct down force from the heel and mid foot arches is fully supported. The ground engaging contact faces of the medial landing blocks can be suspended just above the ground plane. This allows the initial compression force to have minimal resistance while relying on the resiliency of the combined sole system which provides dampening for this region similar to the aforementioned first stage compression. A surface of second elevation can be formed around the landing blocks to enable the secondary arch flex device to embed deeper up into the bottom outsole. The secondary elevation may include but not limit the region containing the landing blocks.

In accordance with yet another aspect of the invention, there is provided a third stage of mid foot compression which comes as the full weight of the wearer is transferred onto the sole system. During this stage, all contact faces of the landing block are fully engaged to the ground plane which directly support the mid foot. As the medial arch compresses down with the weight of the wearer, it may extend medial longitudinal length of the sole system, causing the forefoot region to pivot as a byproduct motion of the medial arch compression. This outward pivoting motion can be defined as adduction, identical to the foot's pronatory motion in a gait cycle. The rebounding motion of the pivot can be defined as abduction. Combined with the midsole, arch flex device, and outsole, the complete system works in unison to fully capture and support the pronatory and supenatory motions of the foot in a gait cycle.

In accordance with still another aspect of the invention, there is provided an outsole including formed through holes to provide an opening for the insertion of the secondary arch flex device. This opening can provide a method for both arch flex devices to physically connect and interlock with each other. The opening can also allow contact pads of the secondary device to docking with the main arch flex device. This direct contact point allows the downward forces to be directly transferred onto the secondary device. It may also provide an adhesion point for the bonding of both devices by chemical, mechanical or temperature means in assembly of the sole system.

In accordance with another aspect of the invention, there is provided a formation of a third elevation surface can be incorporated onto the bottom of the outsole system. It may promote flexing of longitudinal arches and lateral flexing of the forefoot. The third elevation creates grooves on the outsole following the location and curvature of aforementioned midsole and arch flex flex grooves. This ensures the sole system when assembled to flex and bend in unison along the same hinge points as one unit.

In accordance with still another aspect of the invention, a secondary arch flex device is added to the bottom of the outsole design. The functions of the secondary device is to control the directional flex and provide progressive compression resistance needed in the mid foot region. The secondary arch flex device achieves this by attaching to the bottom outsole's landing blocks features. Anchoring at the heel landing block base, it captures and connects all the mid foot landing blocks on the outsole. The main body of the device can be formed with a consistent thickness conforming to the second elevation mid foot contours of the outsole. The secondary arch flex device can be embedded up into the depression cavity formed by the second elevation surface on the bottom outsole. Embedded up into the outsole it is protected from contact to the ground plane.

In accordance with yet another aspect of the invention, when weight is transferred to the mid foot, the secondary arch flex device stabilizes and controls the expansion rate of the landing blocks. It also maintains a controlled directional expansion rate between selected landing blocks to achieve increase resistance in the desired medial arch regions. The expansion of the landing blocks are controlled longitudinally and laterally across the bottom outsole. Resilient material is used to form the secondary device to limit the landing blocks movements. The secondary arch flex device can be formed using thermoplastics to be durable, flexible and able to deflect the weight of mid foot compression. The amount of the resistance needed can be tuned by adjusting the overall thickness of the device. The individual resistance level between and across the landing blocks can also be adjusted independently by varying the thickness and size of the ring sections around landing blocks.

In accordance with another aspect of the invention, additional through slots may be incorporated into the secondary arch flex device to promote directional flex resistance. The slots can be formed following the same location and curvature as the flex grooves formed on the aforementioned midsole. Varying the length and width of the slots will also influence the amount of resistance in expansion rate between the landing blocks. This ensures that the assembled sole system will flex and deflect in unison. Slot can also provide snap fit locking tabs features to combine with the main midsole arch flex device through the aforementioned opening formed into the outsole.

In accordance with another aspect of the invention, there are provided a contact pads formed onto the top surface of the secondary device which can dock with the cavity feature on the main arch flex device through the opening formed into the outsole. This physical contact point allows the downward forces to be directly transferred onto the secondary device. It may also provide an adhesion point for the bonding of both devices by chemical, mechanical or temperature means in assembly of the sole system.

In accordance with another aspect of the invention, as the weight of the wearer transfers onto the foot, the full downward force transfers from the lateral part of mid foot to the medial side. A progressively increased compression resistance may be needed to support forces exerted laterally from the lateral sides to the medial sides of the mid foot. The secondary arch flex device can include a ridge extending upwards from the medial side forming a wall like structure. This medial arch wall structure may connect and reinforce the outer sides of the medial landing blocks while providing increased rigidity for the device. This increased rigidity on the medial sides of the device allows the decreased rigidity towards the lateral side. This forms a transitional compression resistance that can be progressively increased from the lateral to the medial side. The thickness of the arch wall structure can vary to achieve the level of increased medial resistance needed for the wearer.

In accordance with another aspect of the invention, the sole system utilizes the wearer's weight exerted on the footwear in a gait cycle to exercise the arch flex sole system. The system reacts first to the heel strike stage as the heel landing block makes contact with the ground. This anchors the arch flex devices as weight is transferred onto the mid foot at the heads of Talus and Navicular joints. The high arch contours of the sole system then meets and supports the mid foot as it compress downward with the weight of the wearer. A reversed leaf spring resistance effect of the arch flex device then cushions and dampens the compression motion of the mid foot. When full weight is transferred onto the foot, the weight is then shifted onto the inner medial arch side. This flattening of the medial arch is dampened and supported by the secondary arch flex device with the controlled spreading of the landing blocks on the outsole. The high arch contours of the arch flex devices offers a spring like dampening effect in mid foot to compression as it redirects the flex into the outward pivoting motions of the forefoot. The outward pivoting movement of the forefoot is part of pronatory motion and is characterized as adduction, while abduction is the inward pivoting movement of the fore foot. As the weight begins to shift off the rear foot and rolls towards the forefoot's metatarsal and phalanges in the push off stage of the gait cycle, the rebound effect of the arch flex sole system assists the supenation efforts of the foot as it returns to the natural unloaded state.

In accordance with yet another aspect of the invention, the footwear's ability to support and flex with the biomechanical motions of the foot may benefit the comfort level of the foot and relieve pain and pressure caused by non supportive footwear. The landing blocks can also serve as the mounting point for the secondary arch flex device. The high contoured curvatures of the arch flex device dampens, compress, and flex with the foot's natural gait cycle while providing resistance support and rebound energy. Due to the leaf spring like compression resistance support of the mid foot and arch areas, a large percentage of the body weight is absorbed by the mid foot arch regions, allowing a more even redistributing of weight across the entire bottom surface of the foot. As weight is reduced from the heel regions, plantar fascia is allowed to rest on and be supported by the arch flex sole system. This may reduce the symptoms of plantar fasciitis and other related foot problems related to insufficient mid foot support.

In accordance with yet another aspect of the invention, there is provided a mid foot is to support and distribute weight of the foot more evenly, as a result, less weight is also placed on the fore foot. Wearers are able to have less fatigue from the foot and able to be more active as the threshold of comfort level in the footwear is increased. This sole system can also aid in many fore foot related problems like Calluses, Bunions, and sesamoid pains. With the mid foot and inner arch supported, the foot can have better alignment and be more perpendicular to the ground plain. The sole system of this present invention may effectively eliminate over pronation, the excessive inward roll or collapse of the inner arch. Over pronation is due to collapse of the mid foot medial arch causing the plantar fascia to be overly stretched and extended. Which increases the likelihood of developing heel spurs in causing heel pain.

In accordance with yet another aspect of the invention, there are provided devices to improve the utilities features of the footwear. These features include an embodiment for stabilizing and controlling forefoot motions with respect to the outsole.

In accordance with another aspect of the invention, there is provided a new method of adjusting the length of the straps over the upper by sliding the ends of the strap across the perimeters of the outsole. This straps system can be attached in many different areas along the upper and lower outsole to stretch across the foot without causing uneven pressure points for the foot. Multiple straps can be used with independent adjustability to accommodate fit from the different foot shapes of the wearer.

In accordance with yet another aspect of the invention, there is provided an adjustable upper straps system which allows the wearer to simply adjust the straps length by pressing down and sliding the rear base of straps to achieve the proper fit. This upper straps adjustment system having three main components: An embedded track system, A sliding lockable device to travel within the tracks from here on can be referred to as a slide block device, a strap system with one stationary end and one adjustable end attached to the slide block device.

In accordance with another aspect of the invention, there is provided a track system comprises saw tooth teeth organized in a linear pattern to form a track that can be embedded into the main body of the outsole. The tracks are preferably located just within the perimeter of the outsole residing parallel with the sides of the outsole. The tracks may be mounted along its longitudinal axis of the footwear within the medial and lateral sides of the footwear. The track may be positioned on both medial and lateral sides of the rear foot region, and can also be molded onto the bottom sides of the arch flex device. Each track may contain at least one slide block device. More slide blocks may be used to allow for multiple straps.

In accordance with yet another aspect of the invention, there is provided a slide block device made for the adjustment of the straps. The slide block device contains an embedded side that is captured behind the tracks while the exposed side is attached to ends of the upper strap system. The embedded side contains a wall captured behind the track system. The embedded wall also extend downward into the outsole's trench to be captured by the trench walls. This prevents accidental extraction of the slide block device from the track and soles of the footwear. The wall is formed with saw tooth teeth track pattern to interlock with the track's teeth of the same design. This feature insures that the slide block stays in place once adjusted. Connected to the embedded wall is a horizontal wing that extends outward beyond the sides of the outsole. This exposed wing bends upward to form a tab with a through hole for attachment to the upper strap. The exposed tab can be fastened to one end of the straps as the other end may be attached to the outsole in a fixed position. The sliding tabs device can be used on both lateral and medial sides of the footwear.

In accordance with another aspect of the invention, the slide block device may be adjusted by first pushing down onto the tab releasing the interlocking teeth of the track. Then sliding the slide block device forward or rearward along the path of the track to achieve the desired fit of the straps. Once the proper fit is obtained, the block is able to lock in place with the teeth of the track, thus securing the strap system in place. Resistance force may be needed to keep the slide block device in constant engagement to the teeth of the track system in securing the block's position. This engagement force can be provided by formed in features on the outsole to apply constant pressure to keep the slide block device engaged and in place. However, this engagement force also can be pliable and flexible to allow disengagement and travel of the slide block device.

In accordance with yet another aspect of the invention, there are provided features to stabilize and controlling forefoot motions with respect to the outsole and to vertically hang and combine both footwear together for storage purposes. The fore foot toe loop stabilizer device can be constructed as two separate parts to be combined as a assembled system. One embodiment of the lower forefoot toe loop stabilizer device includes a toe post connected to a base and serves three main functions: 1) to aid in maintaining proper positioning of the forefoot with the sole system; 2) to provide a mechanical connection with the upper toe loop stabilizer V hook; and 3) to provide a snap fit feature in the base to mechanically connect with the footwear from the other foot. The lower forefoot toe loop stabilizer base may be assembled from underneath the outsole with the toe post to protrude through the outsole and the midsole toe post hole. It is sandwiched between the upper's straps in the toe loop area, between the toes. The toe post keeps the forefoot from moving side to side while keeping the forefoot in optimum an position with the curvature of the outsole. At the top of the post is a formed in slot to allow mechanical attachment with the upper V hook.

In accordance with yet another aspect of the invention, there is provided a snap fit system as a means of securing or interlocking the left and the right footwear together for the primary purpose of storage and convenience to carry. The toe loop stabilizer base device to interlock outsoles insures that the bottom of the outsoles are facing each other when it's stored. With the bottom outsole facing each other, the footwear has less of a chance to contaminate its surroundings. This convenient storage feature may be used in a wide range of footwear but in this application it is primarily used in the sandal design. The snap fit system may be built into part of the toe post of a thong type sandal located between the toes or phalanges of the first and second metatarsal. It includes a base with an open circular slot resembling a "C" shape opening on one end, with the other end connected to the post. The base is of a larger shape than the post to prevent from being pulled up through the bottom outsole toe post hole. The "C" shape slot opening is of the same diameter of the toe post. Each snap fit device contains a male end as the post, and female end as the "C" shape slot. This allows the device to interlock with another identical part. The snap fit unit base sits in its own molded cavity embedded into the bottom outsole. The bottom surface of the base sits flush or slightly sub flush to the bottom outsole surface. The snap fit device's base device perimeter walls surface can be angled or beveled. The outsole cavity walls housing the base can also be angled or beveled in the same manner. This serves as a method of keeping the base trapped in place of its outsole cavity when the snap fit system is not in use. When the use of the snap fit system is required, the base can be released from its cavity by pushing downward on the V hook from the top side of the footwear. This will dislodge the base from its cavity and fully expose the snap fit base. This process is then repeated on the other shoe. With both the snap fit bases exposed, one of the toe loop stabilizer device base maybe required to rotate 180 degrees to mate with the other base. As now, both plates are attached and the footwear is combined into one unit with both bottom outsoles facing each other. The cavity molded into the outsole can also be designed to accept the 180 degree rotated base from the other snap fit unit. When both bases are combined allowing the other rotated snap fit unit a cavity to rest in. As both left and right footwear attached together, it becomes a compact and easy way to store the footwear for packaging and shipping of the product. Such attachment also provides benefits for the wearer as ease of secure storing and carrying the footwear.

In accordance with yet another aspect of the invention, there are provided two parts of the forefoot toe loop stabilizer device comprising of an upper hook device to sit atop of the straps of the footwear. The hook is formed using thermoplastics to be durable, flexible and able to support at least twice the weight of the footwear. The upper hook devise contains semi ridged arms to stretch over the top of each thong type sandal strap. This forms a V shape hook which rests atop of the straps to serve three main functions: 1) to provide a structural support for the footwear straps and upper design; 2) to provide a method of vertically carrying or storing the footwear product; and 3) to establish product brand identity incorporated with the highly visible V shape hooks design at the upper's forefoot region. The upper V shape hook is located at the base above the thong style straps as arms hugging down onto the top of the forefoot phalanges area to secure the straps in place during the push off stage of the gait cycle. The additional structure helps to holds and support the foot down onto the outsole. The upper v hook allows the footwear to be stored vertically by hanging off its own hook. It may also be useful as carrying, storing or drying the footwear. For example the hooks can be used to hook onto pants or shorts pockets, belt or belt loops when walking barefoot on the beach, which eliminates the need to carry the footwear with the hands. As a form of brand and product identity the V hooks is placed at the highly visible area of the forefoot. This allows the placement of logo and/or trademark that represent the product line. Different colors, textures and finishes may be use on the hooks to coordinate with other parts of the footwear to express differences in model range and styles. The materials and durameter used in the upper V shape hook may differ from the lower toe post base depending upon the performance specification needed. The toe loop stabilizer device base can be formed using softer thermoplastics to allow bending movement between the toe area. Softer compounds also allow the base clip to flex when attaching to another base's "C" shape slot of the same design.

In accordance with yet another aspect of the invention, the toe loop stabilizer device may include a base anchored from the bottom outsole to help secure the forefoot in place during a gait cycle. This toe loop stabilizer device can also serve as a forefoot straps support devise to center and stabilize the toe loop to the outsole in preventing unwanted side to side motion. This will keep the foot in position with the contours of the outsole.

In accordance with another aspect of the invention, there is provided hook device allowing the footwear to be hung on the pockets rather than be carried by hand. Sandals as a seasonal footwear can be separated when traveling or stored. A device to mechanically connect both the left and right foot may help ease storage of the footwear. The ability to attach both footwear together allows for easy storage and keep wearer from misplacing each shoe. It may be particularly useful in the thong style sandals as footwear often used for traveling and on vacations

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

To create a dynamically supportive motion control sole system one must understand the pronation and supenation motions of the foot during a gait cycle. This sequence of movements describes how the foot flexes and compresses to absorb and support the weight of the body. It should be examined and translated into applicable flexing motions in the sole system of the footwear design. Once understood, the range of flexing motions of the foot can now be fully supported by a sole system tuned to provide progressive resistance in directional flex.

Human Gait Biomechanics

Figure 1A:
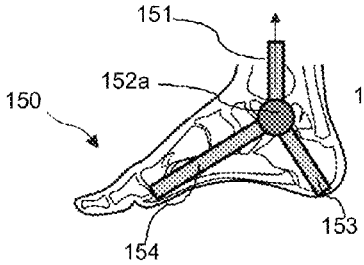
FIG. 1A Illustrates the sagital plane mechanic bone structure positions of a foot in supenation shown from the medial side.
Figure 1B:
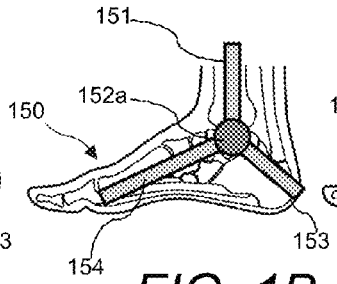
FIG. 1B Illustrates the sagital plane mechanic bone structure positions of the foot in a natural unloaded state shown from the medial side.
Figure 1C:
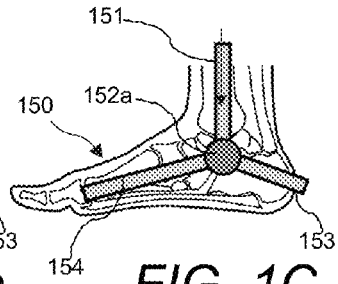
FIG. 1C Illustrates the sagital plane mechanic bone structure positions of the foot in pronation shown from the medial side.

The biomechanical bone structure movements of pronation and supenation are described in FIGS. 1A-3C. FIG. 1A shows a medial side view of the foot 150 in the sagital plane as it supenates in plantarflexion. The pronation and supenation are illustrated by the mechanical positions of the forefoot 154 in relation with the angle of rear foot 153, pivoting around a first axis of rotation 152*a* coming out of the page, resulting from a vertical motion 151. FIG. 1B shows the medial side view of the foot 150 in a natural unloaded state on the sagital plane. The pronation and supenation are illustrated with the mechanical positions of the forefoot 154 in relation with the angle of rear foot 153, pivoting around the axis of rotation 152*a* resulting from a vertical motion 151. FIG. 1C shows the medial side view of the foot 150 in the sagital plane pronates as dorsiflexion. The pronation and supenation are illustrated with the mechanical positions of the forefoot 154 in relation with the angle of the rear foot 153, pivoting around the axis of rotation 152*a* resulting from the vertical motion 151.

Figure 2A:
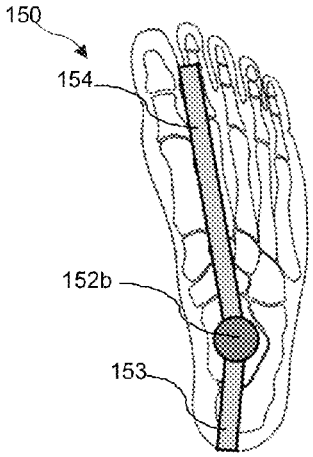
FIG. 2A Illustrates the horizontal plane mechanic bone structure positions of the of the foot in supenation.
Figure 2B:
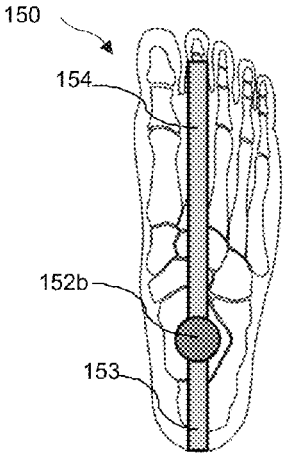
FIG. 2B Illustrates the horizontal plane mechanic bone structure positions of the foot in a natural unloaded state.
Figure 2C:
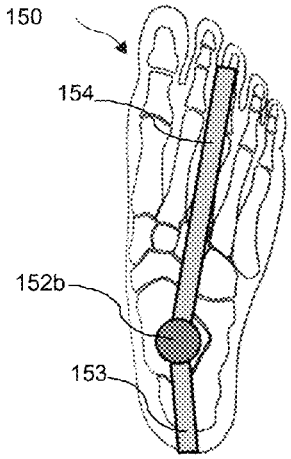
FIG. 2C Illustrates the horizontal plane mechanic bone structure positions of the of the foot in pronation.

FIG. 2A shows a top view of the foot 150 as it supenates in abduction. It is illustrated with the mechanical positions of the forefoot 154 tilting inward with relation to the angle of the rear foot 153, pivoting from a second axis of rotation 152*b*. In FIG. 2B the top view of the foot 150 is shown in a natural unloaded state from the horizontal plane. It is illustrated with the mechanical positions of the forefoot 154 in line with the rear foot 153, from the axis of rotation 152*b*. FIG. 2C shows the top view of the foot 150 in the horizontal plane as it pronates in adduction. It is illustrated with the mechanical positions of the forefoot 154 tilting outward with the angle of the rear foot 153, pivoting from the axis of rotation 152*b*.

Figure 3A:
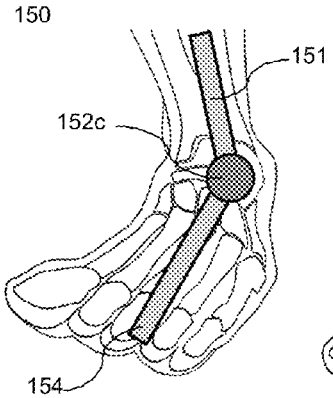
FIG. 3A Illustrates the frontal plane mechanic bone structure positions of the foot in supenation shown from the front.
Figure 3B:
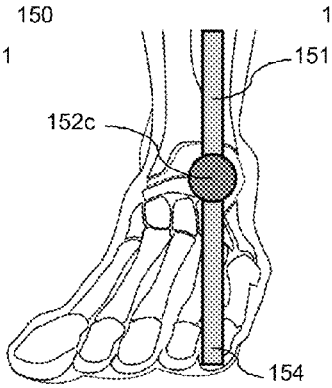
FIG. 3B Illustrates the frontal plane mechanic bone structure positions of the foot in a natural unloaded state shown from the front.
Figure 3C:
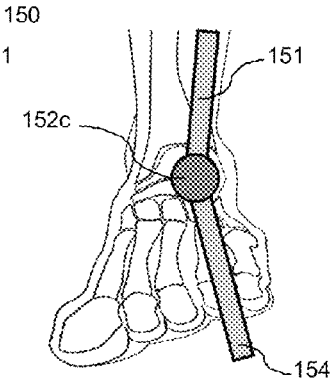
FIG. 3C Illustrates the frontal plane mechanic bone structure positions of the foot in pronation shown from the front.

FIG. 3A shows the front view of the foot 150 as it supenates in inversion. It is illustrated with the mechanical positions of the forefoot 154 rotated inward with relation to the vertical upward source of motions 151 while pivoting from a third axis of rotation 152*c*. FIG. 3B shows the front view of the foot 150 in a natural unloaded state on the frontal plane. It is illustrated with the mechanical positions of the forefoot 154 in line with the vertical central source of motions 151 while pivoting from the axis of rotation 152*c*. FIG. 3C shows the front view of the foot 150 in the frontal plane as it pronates in inversion. FIG. 3C shows the front view of the foot 150 in the frontal plane as it pronates in eversion. It is illustrated with the mechanical positions of the forefoot 154 rotating outward with relation to the vertical central source of motions 151 while pivoting from the axis of rotation 152*c*.

The biomechanical bone structure movements of pronation and supenation are identified in FIGS. 1A-3C. However, these movements need to be quantified and translated into applicable support motions of the sole system 2 (see FIG. 7). The sequence of a foot's movement translates into bending, flexing and expansion of the foot's external shapes. This is due to the tendons, muscles and padding surrounding the foot's bone structure. To fully support the movements of the foot, we need to understand how the external shapes of the feet react to each stage of the gait cycle as the weight of the body transfers onto different regions of the foot. Understanding of these motions may guide the design of the sole system 2 in fulfilling the support and progressive resistance in directional flex required in this current article of footwear invention.

Figures 4A, 4B, 4C, 4D, 4E:
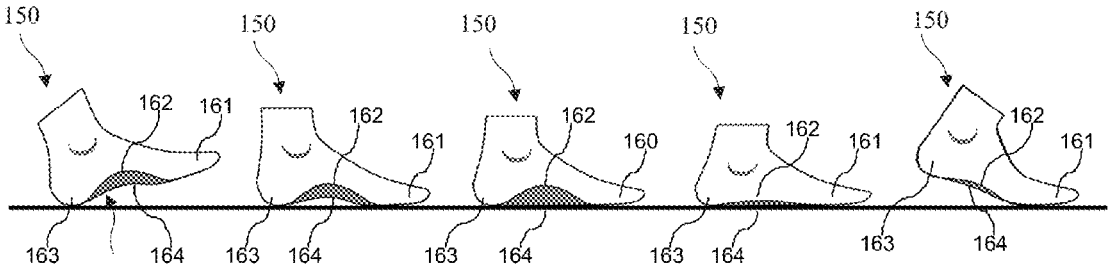
FIGS. 4A-4E Illustrate the sagital plane sequence of motions the foot goes through in a gait cycle as the shape of the foot changes to distribute the weight of the body.

The external motions and movements of the foot are results of bone structure, tendons and muscles reacting in support of the body weight. As the shape of the foot changes with every stage of the gait cycle to absorb and distribute the weight of the body, parts of the foot shift, flex and compress as a result. These movements can be used to directly incorporate into the supportive motions of the sole system 2. FIGS. 4A-4E Illustrates the sequence of external motions the shape of the foot 150 goes through in a gait cycle from the sagital plane on the medial side. A heel strike is shown in FIG. 4A as the foot 150 first makes contact to the ground plane 169. The sole system 2 preferably addresses the first point of impact of the foot 150. In FIG. 4B the foot 150 makes full contact to the ground plane 169 without body weight being transferred onto the foot 150. This is shown by the position of the medial arch 162 and lateral arch 164 in an arched natural unloaded state. As pronation begins the initial weight is first applied to the foot 150 in FIG. 4C, the lateral arch 164 is shown collapsed, flattened against the ground plane 169. This marks the first stage of mid foot compression resistance needed in the sole system as the shape of the foot 150 changes to absorb the weight of the foot. As the full weight of the body transfers to the foot 150 shown in FIG. 4D, the medial arch 162 collapses to the ground plane 169. This marks the second stage of total mid foot compression resistance support needed in the sole system 2. In FIG. 4E the weight of the body is lifted off the mid foot and transferred forward onto the fore foot 161 as the push off stage of the gait cycle begins. This marks the end of pronation as a compressed foot rebounds in supenation to return the foot to its unloaded state.

Figures 5A, 5B, 5C:
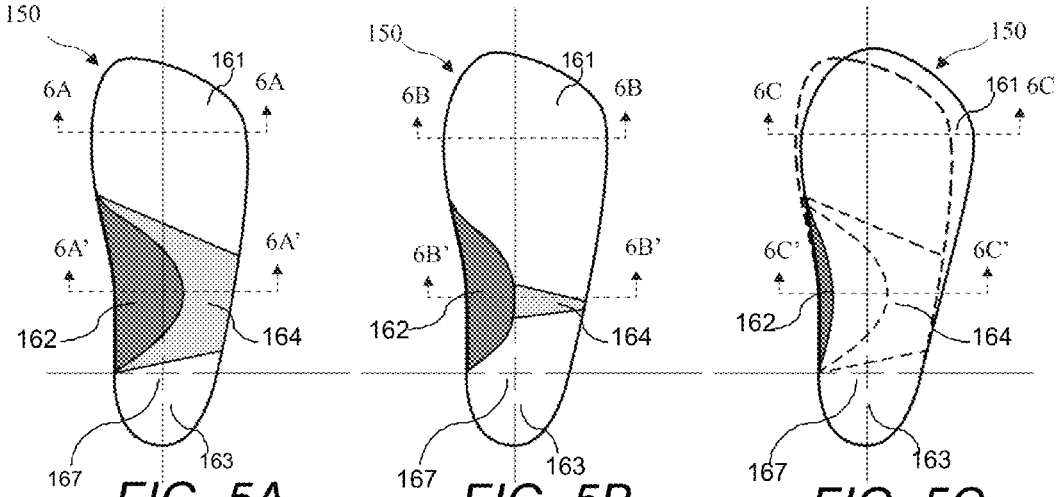
FIGS. 5A-5C Illustrate the horizontal plane sequence of motions the foot goes through in a gait cycle as the shape of the foot changes to distribute the weight of the body.

FIGS. 5A-5C Illustrate the sequence of motions the foot 150 goes through in a gait cycle in the horizontal plane as seen from the bottom view perspective. As the shape of the foot changes with every stage to absorb and distribute the weight of the body, parts of the foot shift, flex and compress as a result. A stationary center heel axis line 167 is used as a reference point for the movement of the foot 150. FIG. 5A shows the foot 150 in a natural unloaded state without the body weight being transferred upon it. This is shown by the large shaded medial arch area 162 and lightly shaded lateral arch area 164 suspended just above the ground plane 169. The fore foot area 161 and heel area 163 may have contact to the ground plane which are shown in white. Pronation begins as the initial weight is first applied to the foot 150 in FIG. 5B. Shown as a decreased lateral arch area 164 in FIG. 5B compare to the same area in FIG. 5A, the area 164 are shown compressed against the ground plane as well as some of the medial arch areas 162. This is the first stage of mid foot compression as lateral arch compresses to the ground plane and shapes of the foot 150 changes to absorb the weight of the foot. As the full weight of the body transfers to the foot 150, the medial arch 162 also collapses to the ground plane 169 shown in FIG. 5C. This is the second stage of mid foot compression resistant support needed in the footwear sole system 2. The original position of FIG. 5A in dotted lines is also shown with FIG. 5C to emphasize the forefoot 161 adduction movements as part of pronation. The deflection forefoot 161 movement of adduction marks the third stage of mid foot compression to be supported by the sole system 2. These movements can be directly incorporated into the supportive flexion motions of the sole system 2.

Figures 6A, 6B, 6C:
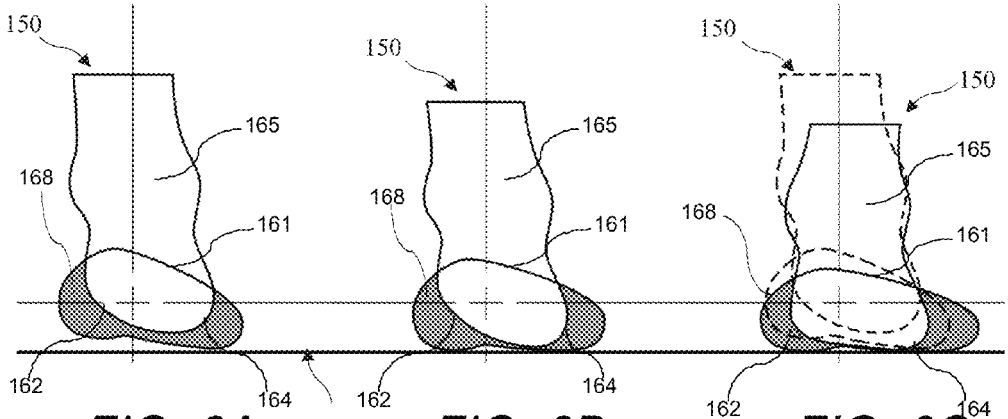
FIGS. 6A-6C Illustrate the frontal plane sequence of motions the foot goes through in a gait cycle as the shape of the foot changes to distribute the weight of the body.

FIGS. 6A-6C are cross-sectional views taken along lines 6A-6A and 6A'-6A' of FIG. 5A, along lines 6B-6B and 6B'-6B' of FIG. 5B, and along lines 6C-6C and 6C'-6C' of FIG. 5C, and illustrate the sequence of motions the foot 150 goes through during a gait cycle. As the shape of the foot 150 changes with every stage to absorb and distribute the weight of the body, parts of the foot shift, flex and compress as the result. A stationary center heel axis line is shown to index the movement of the foot. FIG. 6A shows a mid foot cross-section 165 taken along lines 6A'-6A' and a forefoot section 168 taken along lines 6A-6A in a natural unloaded state. This is shown by the shaded medial arch 162 and lateral arch 164 area without contact to the ground plane 169. Pronation begins as the initial weight is first applied to the mid foot 150 in FIG. 6B. As the forefoot section 168 contacts the ground and begins to transfer weight, the lateral arch 164 of the mid foot section 165 taken along lines 6B'-6B' is shown as pressed down against the ground plane 169. This marks the first initial stage of mid foot compression and forefoot 168 deflection motion needed to be captured by the sole system 2 as shapes of the foot 150 change to absorb the weight of the foot. As the full weight of the body transfers to the mid foot 150, the medial arch 162 collapses to the ground plane 169 as shown in FIG. 6C as the fore foot section 168 taken along lines 6C-6C flattens and expands. This marks the second stage of mid foot compression and expansion resistant support needed in the sole system 2. The original position of FIG. 6A in dotted lines are also shown with FIG. 6C to emphasize the forefoot 168 adduction movements as part of pronation. The full compression of the medial arch 164 taken along lines 6C'-6C' of FIG. 6C. The deflection movement of adduction marks the third stage of mid foot compression to be supported by the sole system 2. These movements can now directly be incorporated into the supportive motions of the sole system.

The compression stage of pronatory movements are shown in 3 stages. Key sequences of motion needed to be captured by the sole system 2 are described above. In FIGS. 4B, 5A and 6A the same preload stage motions are shown in three different views. In FIGS. 4C, 5B and 6B the same first stage compression is shown in three different views. In FIGS. 4D, 5C and 6C the second full compression stage is also shown in three different views. Now the three dimensional movements of the foot are translated into applicable motions for the sole system 2 to capture and support.

The movements of pronation and supenation have now been described and may be a basis for specifying a sole system. In order to fully support the body weight of the wearer, while providing a progressive resistance in a low profile sole system, a combination of an orthotic device, midsole and outsole system is needed. An arch flex orthotics device combined together with the midsole and outsole can form a system to achieve progressive mid foot compression resistance and flex associated with pronation motions of the foot. This combination of components can work together as a system to achieve a progressive mid foot compression resistance and directional flex associated with pronatory motions of the foot.

Orthotic Footwear Design

Figure 7:
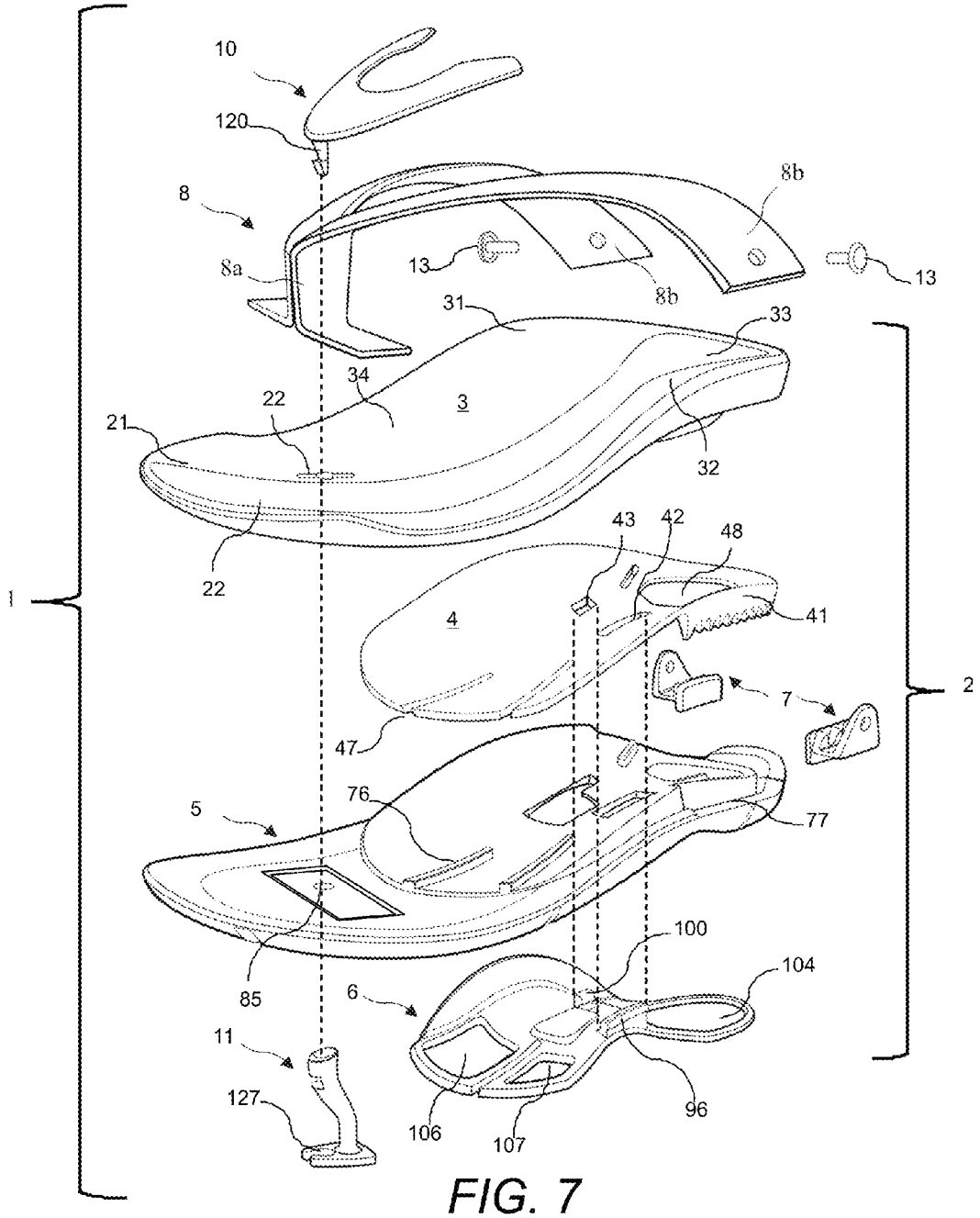
FIG. 7 is an exploded front three quarter view of an article of footwear incorporating orthotic insert devices and an upper strap, according to the present invention.

An exploded top three quarter view of an article of footwear 1 including an upper 8 and a dynamic supportive shoe sole system 2 having a general outline of the foot 150, according to the present invention, is shown in FIG. 7. The sole system 2 includes a midsole 3, an integrated arch flex device 4, an outsole 5, and a secondary arch flex device 6 designed to provide support and progressive resistance in pronation and supenation motions of the foot during a gait cycle. The upper 8 may be a strap upper and holds a wearer's foot in place to the sole system 2. The arch flex device 4 is captured between the midsole 3 and the outsole 5. The secondary arch flex device 6 is used with the arch flex device 4 in capturing the outsole 5. Slide blocks 7 designed for attachment to the upper 8 are installed between the arch flex orthotic's 4 tracks 40 and 41 and the outsole 5. A "V" shaped hook 10 designed for strap support and vertical storage is connected to a toe loop stabilizer base 11 for stabilizing forefoot movements. The "V" shaped hook 10 also provides a method for attaching two footwear 1 together. Additional straps 9 and 12 can also be added to the upper strap 8 to better support and secure the footwear 1 to the foot 150 (see FIG. 10). A full upper design 16 may also be attached to the sole system 2 (see FIG. 33). The full upper design 16 may also utilize the slide blocks 7 with alternative strap configurations (see FIG. 32) to adjust straps 14 and 15 to achieve proper fit of upper 16 to the foot 150 (see FIG. 34).

The bottom outsole 5 captures the formed arch flex orthotic device 4 and slide blocks 7. The formed secondary arch flex device 6 is also used in attaching to the bottom of outsole 5 as it interlocks with the midsole arch flex device 4 through the outsole 5. Rivets or other fastening devices 13 are used to connect the strap rears 8*b* to the slide blocks 7. The strap fronts 8*a* connect and insert into a forefoot toe loop slot 22 in the midsole 3 forming a thong type strap structure.

Figure 8:
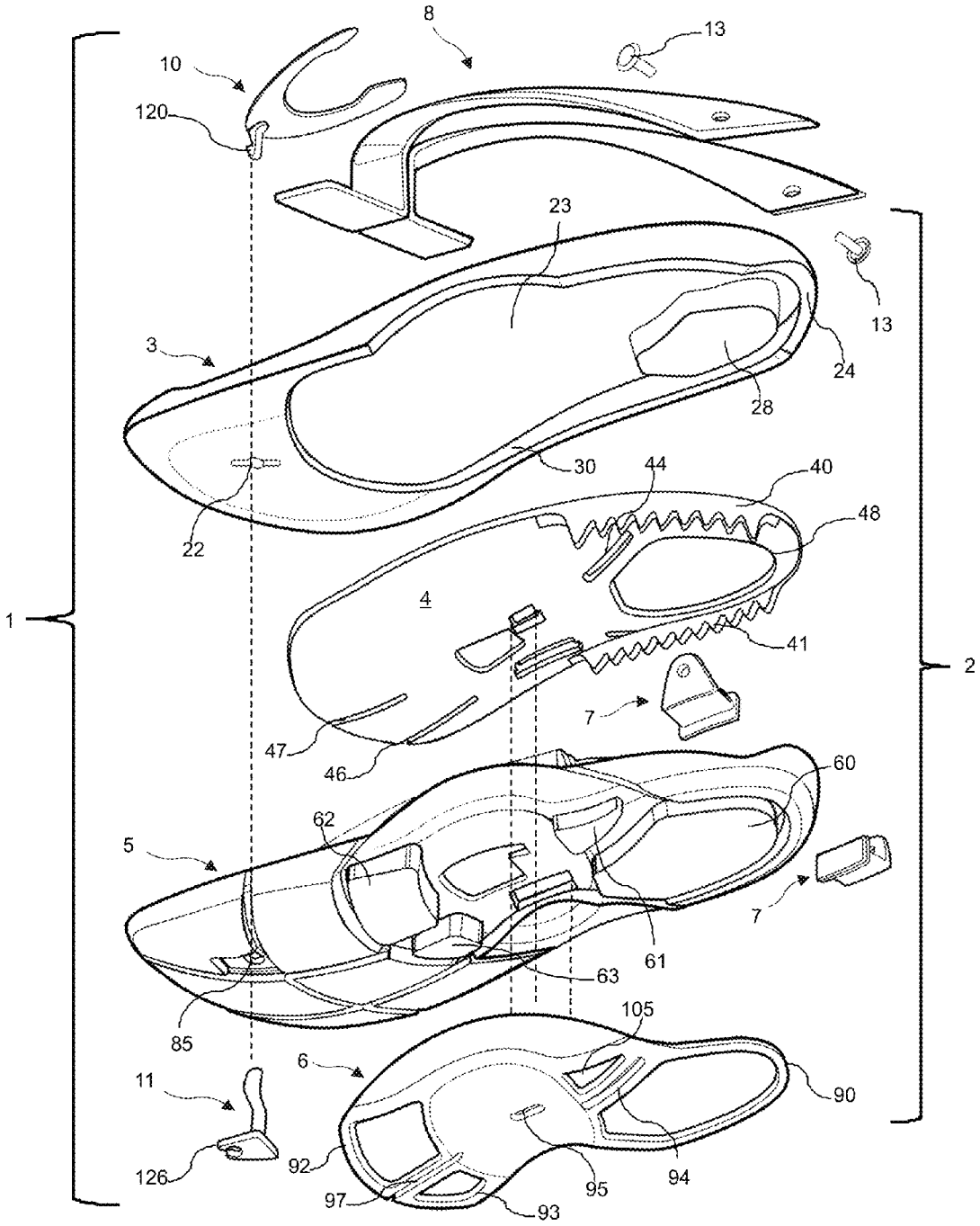
FIG. 8 is an exploded bottom rear three quarter view of the footwear showing the orthotic insert devices and upper strap, according to the present invention.

FIG. 8 shows an exploded bottom three quarter view of the footwear 1 showing underside detail of its components. FIG. 8 also illustrates the sequence of assembly from the bottom as the arch flex orthotic device 4 and the secondary arch flex device 6 are connected through the formed in opening of 65, 66 in the outsole 5. Storage hook device's toe loop stabilizer base 11 is also shown able to insert through the formed hole 85 on the outsole 5 and slot 22 on the midsole 3. The toe loop stabilizer base 11 then connects with the upper "V" shaped hook 10. Sliding blocks 7 are shown in the assembly sequence.

Figure 9:
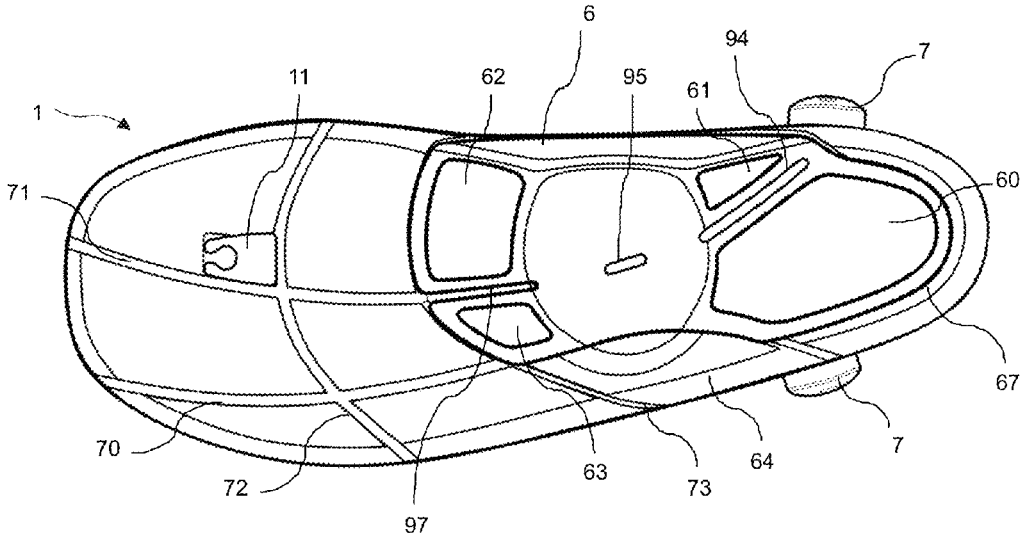
FIG. 9 shows a bottom plan view of an assembled footwear according to the present invention.
Figure 10:
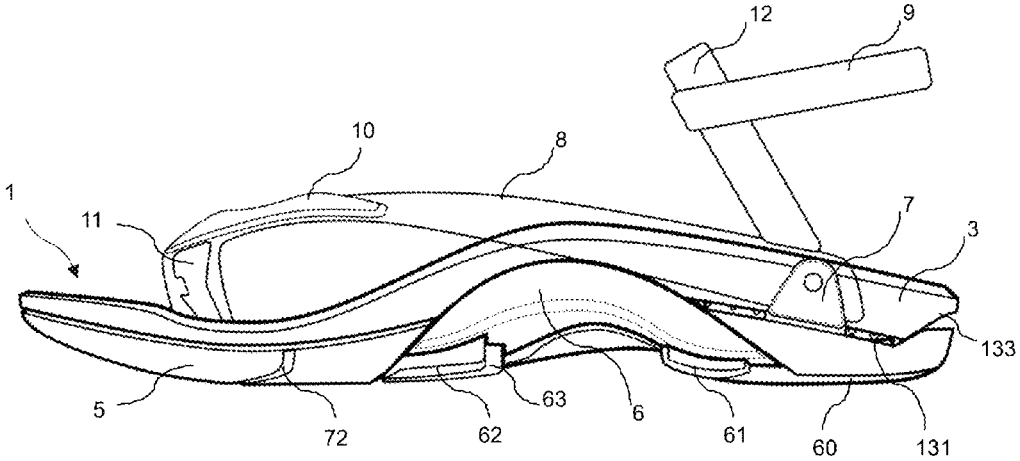
FIG. 10 shows a side view of the assembled footwear according to the present invention.
Figure 11:
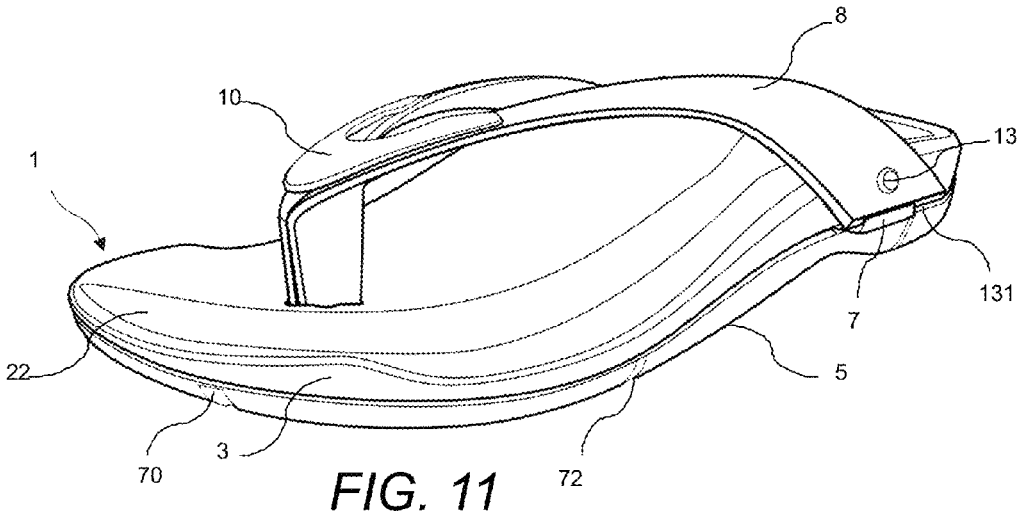
FIG. 11 shows a front three quarter view of the assembled footwear according to the present invention.
Figure 12:
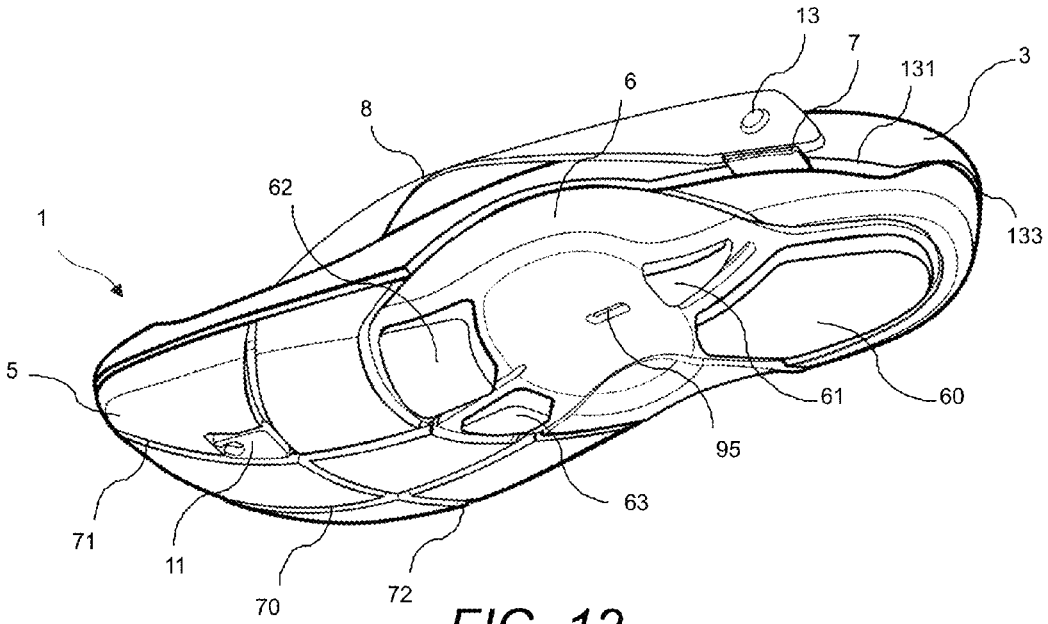
FIG. 12 shows a bottom rear three quarter view of the assembled footwear according to the present invention.

FIGS. 9-12 shows multiple views of the assemble footwear 1, which with all its components can form a system to fully support and provide progressive mid foot compression resistance for the foot. FIG. 9 shows the assembled bottom plan view of the footwear 1 in detail. FIG. 10 shows an assembled side view of the footwear 1 in detail with optional ankle strap 9 attached to strap 12 as the base of strap 12 is fastened to the sliding block device 7. FIG. 11 shows the assembled front three quarter view of footwear 1. FIG. 12 shows the assembled bottom rear three quarter view of the footwear 1 according to the present invention in detail.

Figure 13A:
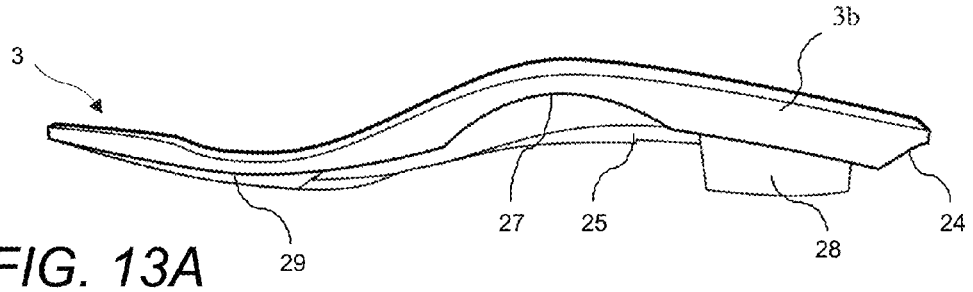
FIG. 13A is a side view of a midsole according to the present invention.
Figure 13B:
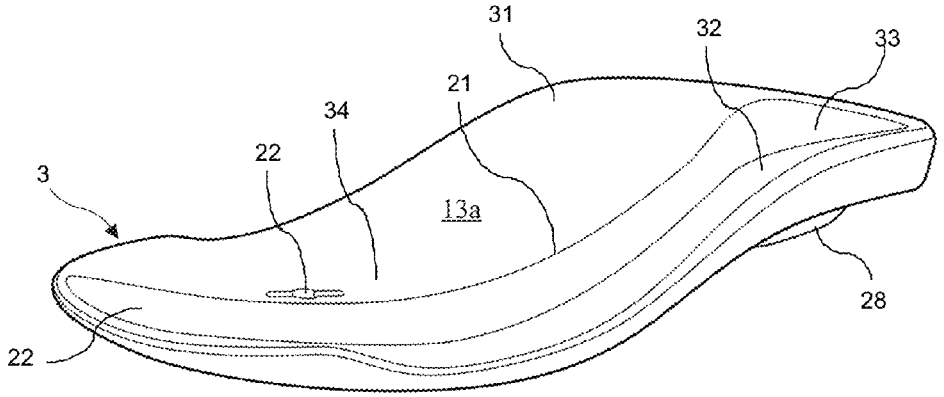
FIG. 13B is a top, front three quarter view of the midsole according to the present invention.
Figure 13C:
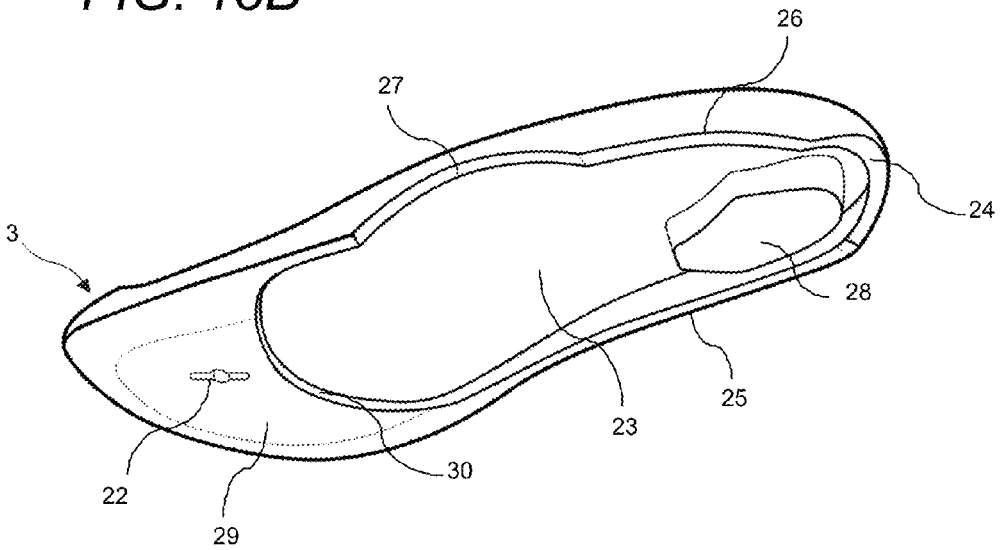
FIG. 13C is a bottom, rear three quarter view of the midsole according to the present invention.
Figure 14A:
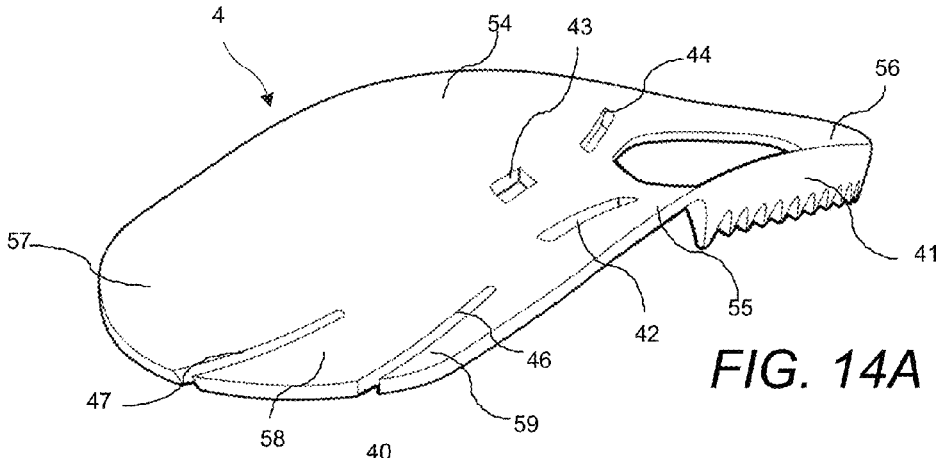
FIG. 14A is a front three quarter view of the arch flex orthotic device according to the present invention.
Figure 14B:
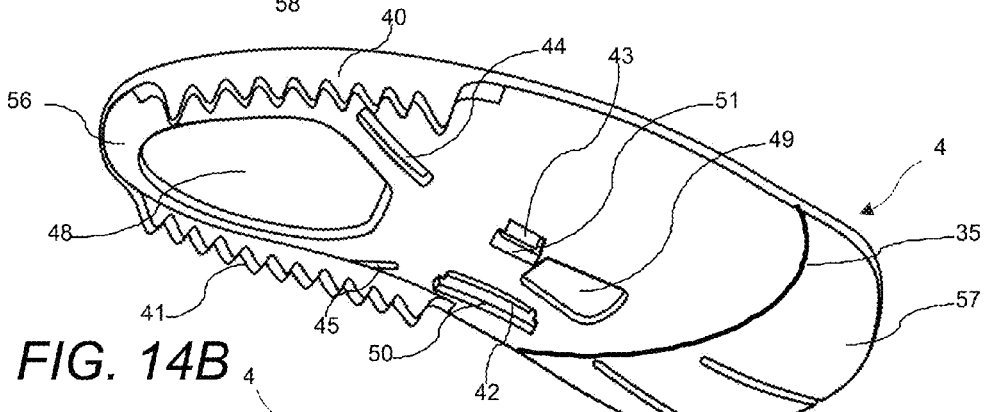
FIG. 14B is a bottom rear three quarter view of the arch flex orthotic device according to the present invention.
Figure 14C:
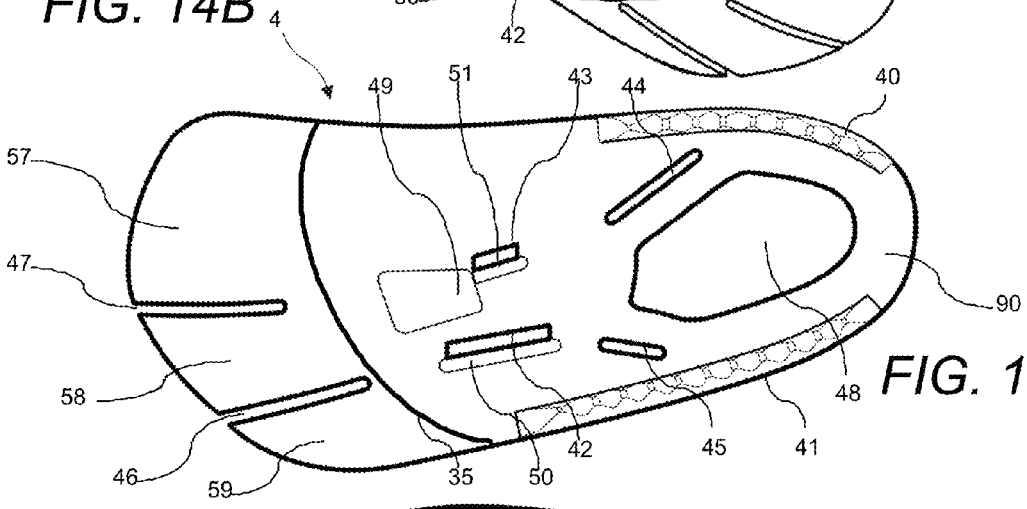
FIG. 14C is a bottom view of the arch flex orthotic device according to the present invention.
Figure 14D:
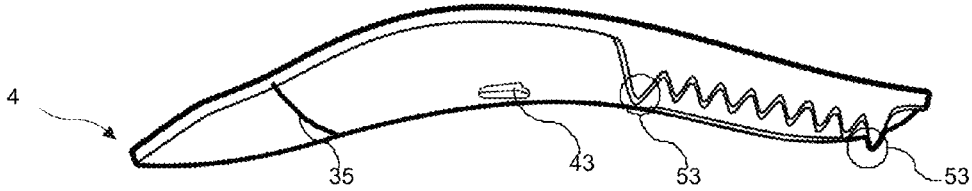
FIG. 14D is a side view of the arch flex orthotic device according to the present invention.

FIGS. 13A-13C shows multiple views of midsole 3 in detail. FIG. 13A shows a medial side view drawing. FIG. 13B shows the lateral, front three quarter view of the midsole 3. FIG. 13C shows the bottom, rear three quarter view of the midsole 3 from the medial side. The midsole 3, in an unloaded state, has a top surface having a natural contour of a bottom of a foot FIGS. 14A-14C show multiple views of the arch flex orthotic device 4 in detail. FIG. 14A shows a lateral, front three quarter view of the arch flex device 4. FIG. 14B is a bottom, rear three quarter view of the arch flex device 4 shown from the medial side. FIG. 14C shows the bottom plan view of the arch flex device 4. FIG. 14D is the medial side view of the arch-flex device 4 in detail.

Figure 15A:
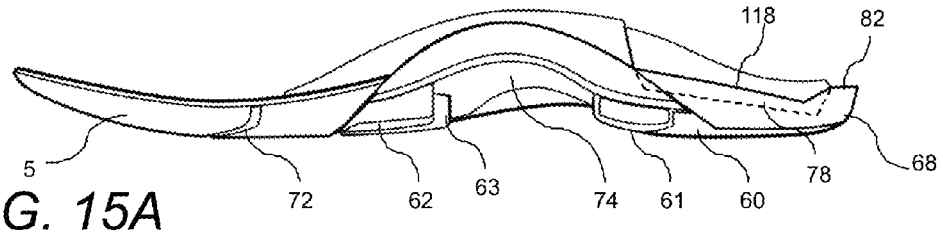
FIG. 15A is a side view of the outsole according to the present invention.
Figure 15B:
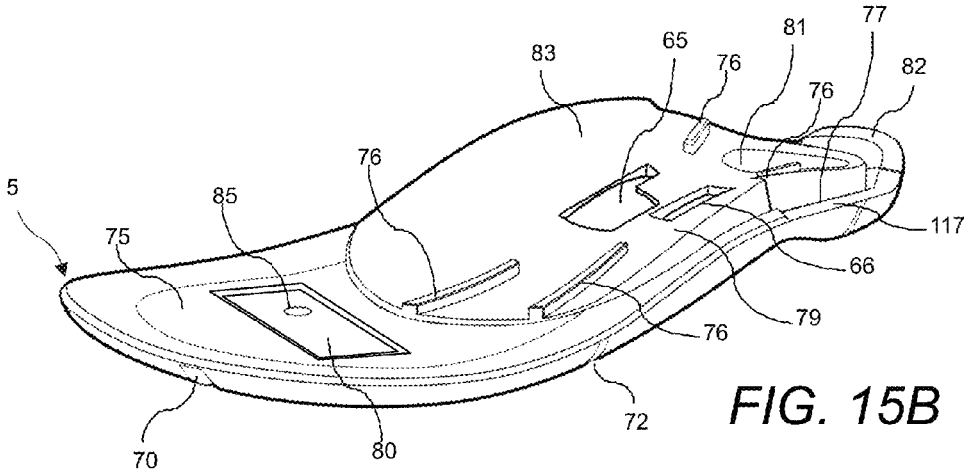
FIG. 15B is a top, front three quarter view of the outsole according to the present invention.
Figure 15C:
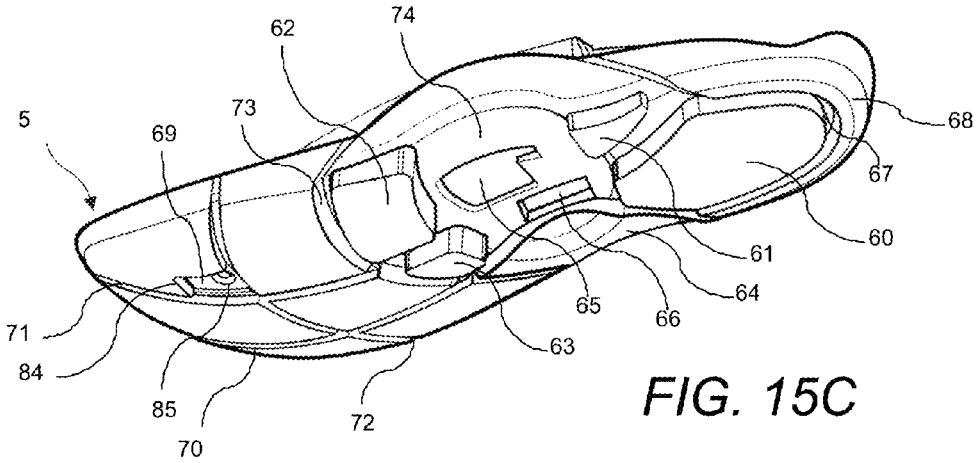
FIG. 15C is a bottom, rear three quarter view of the outsole according to the present invention.

FIGS. 15A-15C show multiple views of the bottom outsole 5 in detail. FIG. 15A shows a medial side view of the outsole 5. FIG. 15B is a lateral, front three quarter view of the outsole 5. FIG. 15C is a bottom, rear three quarter view of the outsole 5 shown from the medial side.

Figure 16A:
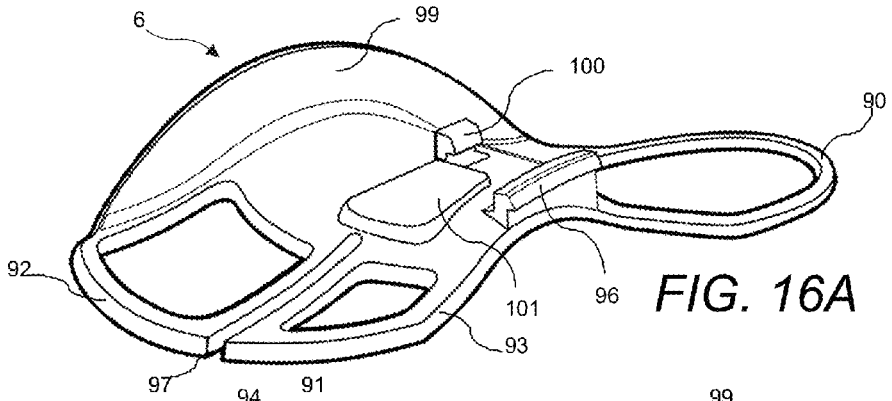
FIG. 16A is a front three quarter view of a secondary arch flex device according to the present invention.
Figure 16B:
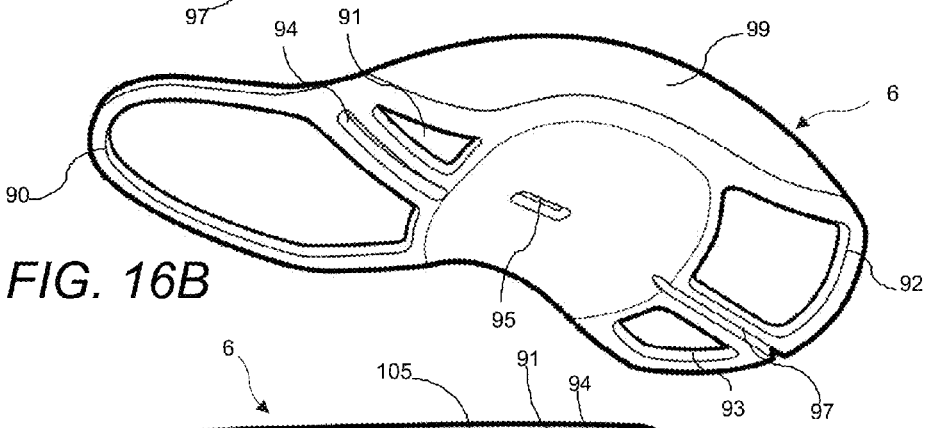
FIG. 16B is a bottom rear three quarter view of the secondary arch flex device according to the present invention.
Figure 16C:
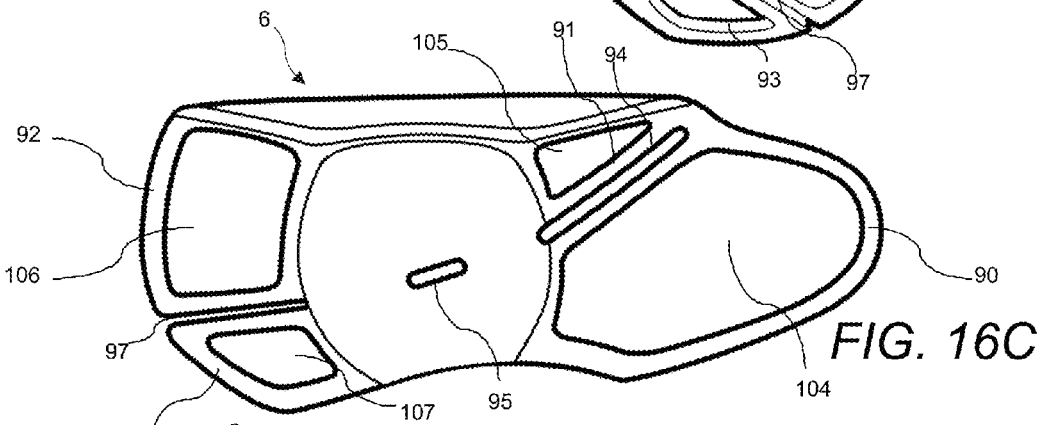
FIG. 16C is a bottom plan view of the secondary arch flex device according to the present invention.
Figure 16D:
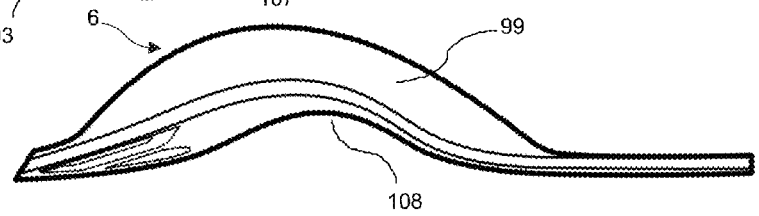
FIG. 16D is a side view of the secondary arch flex device according to the present invention.

FIGS. 16A-16D show multiple views of the secondary arch flex device 6 in detail. FIG. 16A is a lateral, front three quarter view of the secondary arch flex device 6. FIG. 16B is a bottom, rear three quarter view of the secondary arch flex device 6 shown from the medial side. FIG. 16C shows a bottom plan view of the secondary arch flex device 6 showing openings 104, 105, 106, and 107 allowing blocks 60, 61, 62, and 63 (see FIGS. 9 and 15C) to pass through the secondary arch flex device 6. FIG. 16D is a medial side view drawing of the secondary arch flex device 6.

Figure 17A:
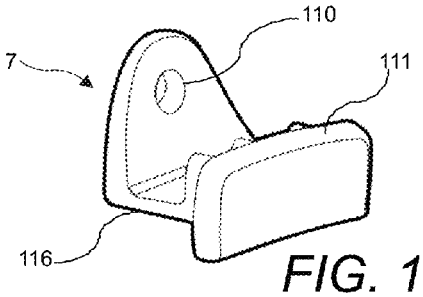
FIG. 17A shows a back side three quarter view of a slide block device according to the present invention.
Figure 17B:
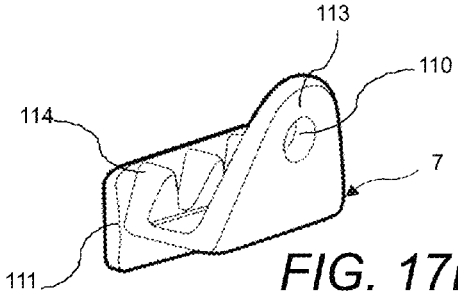
FIG. 17B shows a front side three quarter view of the slide block device according to the present invention.
Figure 17C:
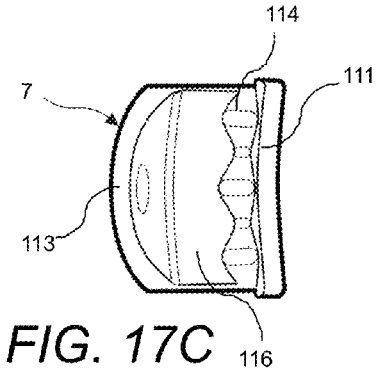
FIG. 17C shows a top view of the slide block device according to the present invention.
Figure 17D:
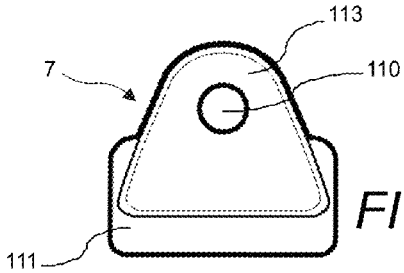
FIG. 17D shows a side view of the slide block device according to the present invention.

FIGS. 17A-17D show multiple detailed views of the slide block device 7. FIG. 17A is an inner three quarter view of the slide block device 7. FIG. 17B is the outer three quarter view of the slide block device 7. FIG. 17C shows the top plan view of the slide block device 7. FIG. 17D is the outer side view drawing of the slide block device 7.

Figure 18A:
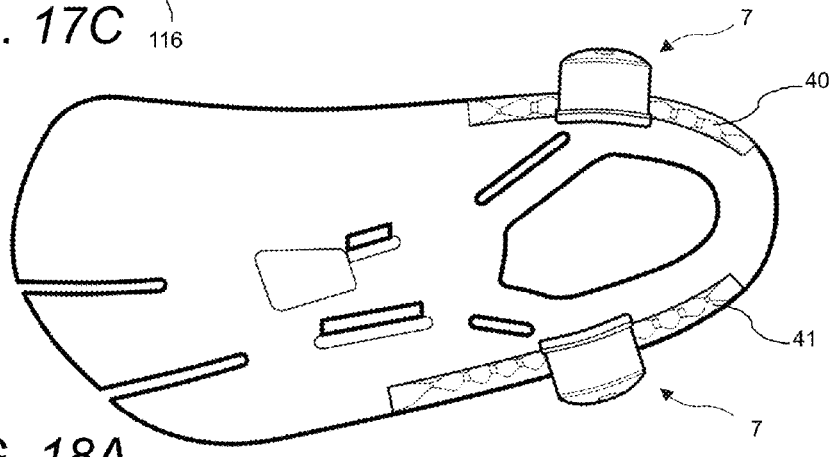
FIG. 18A shows a bottom view of both medial and lateral slide block devices attached to the tracks formed onto the bottom of the arch flex orthotic system according to the present invention.
Figure 18B:
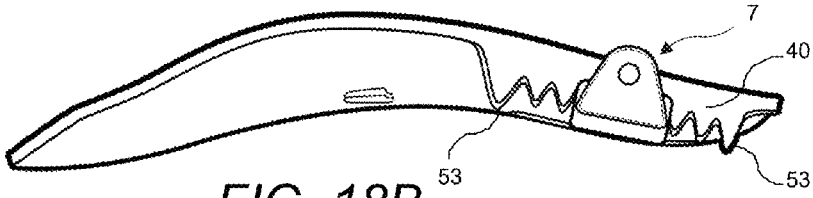
FIG. 18B shows a medial side view of the slide block devices attached to the tracks formed onto the bottom of the arch flex orthotic system according to the present invention.

FIGS. 18A and 18B show the slide block devices 7 installed onto the tracks 40 and 41 formed into the arch flex orthotic device 4. FIG. 18A shows the bottom plan view of the arch flex device 4 with slide block devices 7 installed. FIG. 18B is the medial side view drawing of the arch flex device 4 with the slide block devices 7 installed.

Figure 19A:
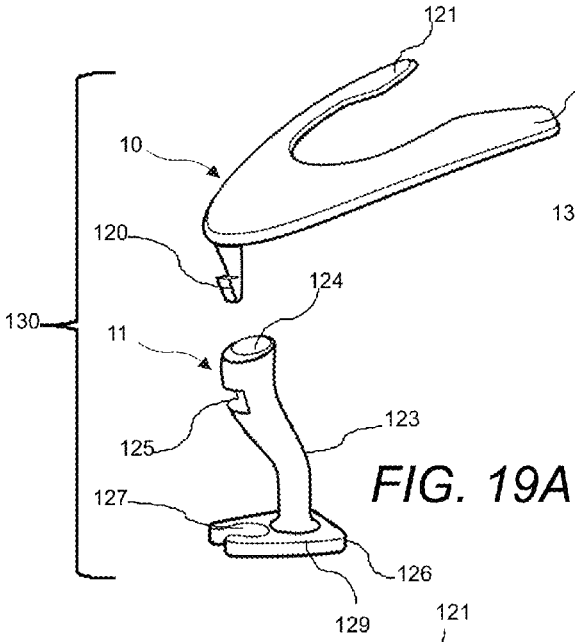
FIG. 19A shows a front three quarter view of the toe loop stabilizer device with upper V hook device and bottom toe loop stabilizer base device in detail according to the present invention.
Figure 19B:
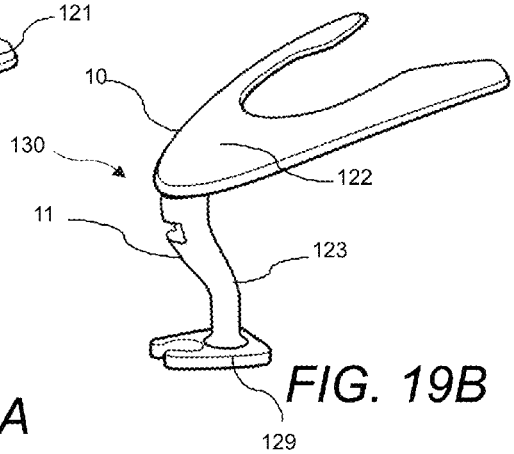
FIG. 19B shows a front three quarter view of the assembled toe loop stabilizer device according to the present invention.
Figure 19C:
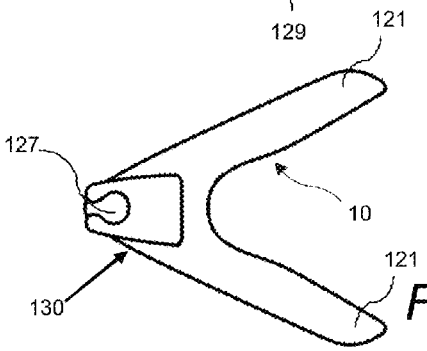
FIG. 19C shows the assembled bottom view of the toe loop stabilizer device according to the present invention.
Figure 19D:
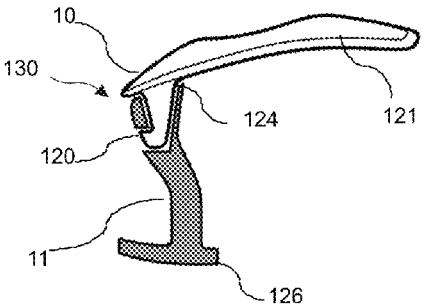
FIG. 19D shows an assembled cross sectional of the toe loop stabilizer device with upper V hook device according to the present invention.
Figure 19E:
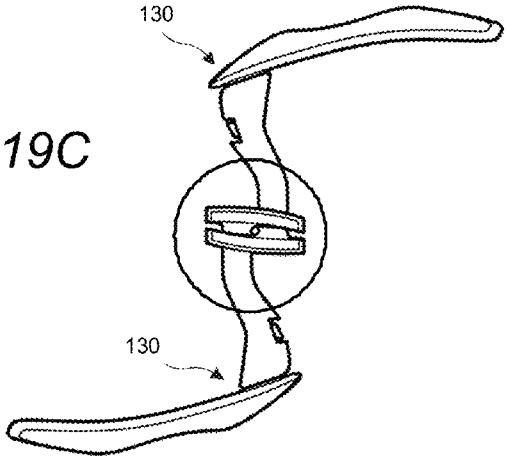
FIG. 19E shows the assembled toe loop stabilizer device's base hook system's attached to another assembled toe loop stabilizer base according to the present invention.

FIGS. 19A-19E show multiple views of the toe loop stabilizer 130. FIG. 19A is the preassembled front three quarter view of the upper "V" shaped hook 10 and toe loop stabilizer base 11. FIG. 19B is the assembled front three quarter view of the toe loop stabilizer 130. FIG. 19C shows the bottom plan view of the assembled toe loop stabilizer 130. In FIG. 19D is the longitudinal center cross-sectional drawing of the toe loop stabilizer 130 showing the upper "V" shaped hook 10's locking tab 120 inserted into the formed in slot 124 atop of the toe loop stabilizer base 11. FIG. 19E shows toe post bases 126 of two assembled toe loop stabilizers 130*s* interlocking with each other by rotating one toe loop stabilizer 130 180 degrees from both the horizontal and the vertical plane.

Figure 20:
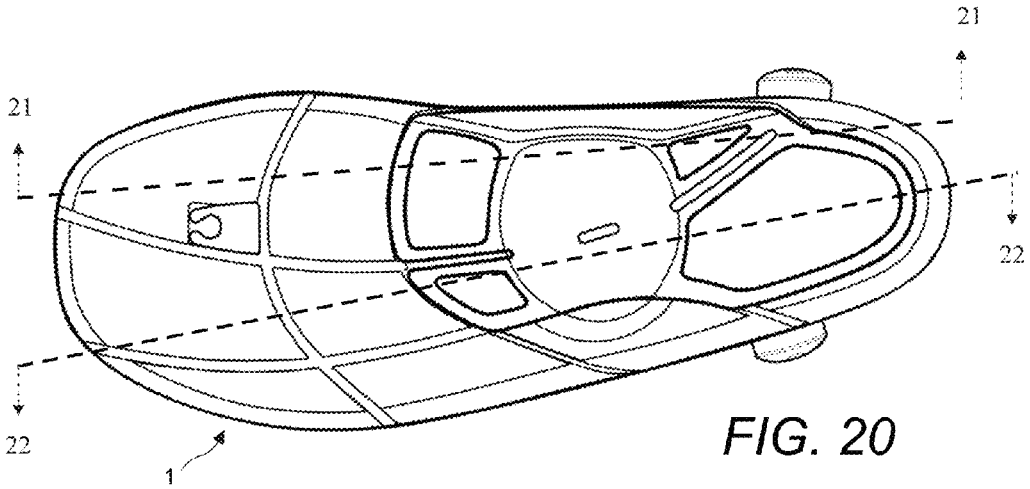
FIG. 20 shows the assembled bottom view of the sole system according to the present invention.
Figure 21:
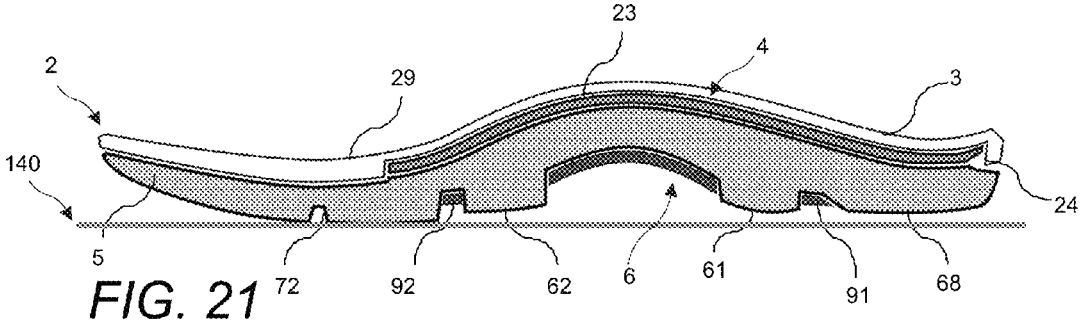
FIG. 21 is an assembled, medial cross-sectional view of the present invention taken along line 21-21 of FIG. 20.
Figure 22:
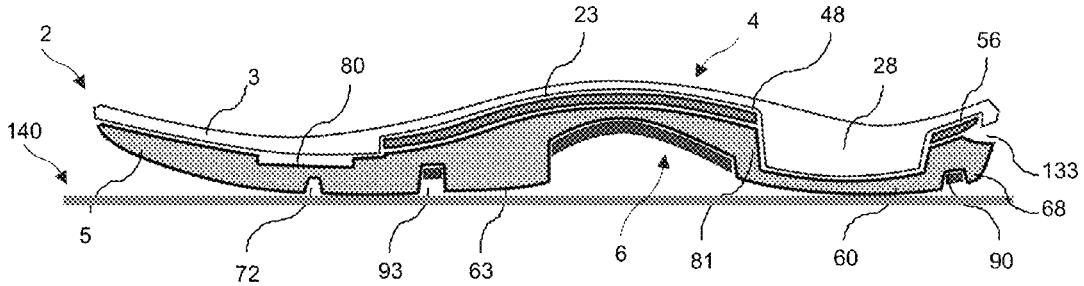
FIG. 22 is an assembled, center cross-sectional view of the present invention taken along line 22-22 of FIG. 20.

FIG. 20 shows the assembled bottom view of the sole system 2 in an unloaded state. In FIG. 21 is a cross-section through the medial side landing blocks 61 and 62 taken along line 21-21 of FIG. 20. FIG. 22 is an assembled, center cross-section view through the heel landing blocks 60 and center mid foot landing blocks 63 taken along line 22-22 of FIG. 20.

Figure 23:
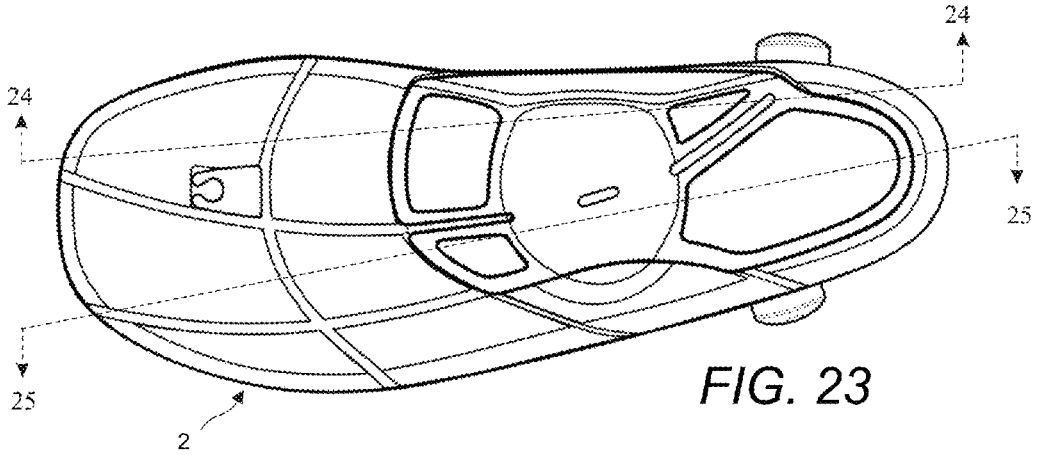
FIG. 23 shows the assembled bottom view of the sole system according to the present invention.
Figure 24:
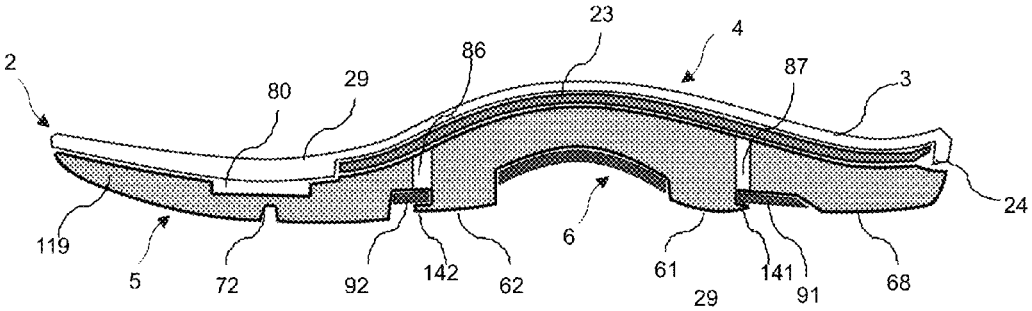
FIG. 24 is an assembled, medial cross-sectional view of the present invention with secondary arch flex inserts captured by landing blocks taken along line 24-24 of FIG. 23.
Figure 25:
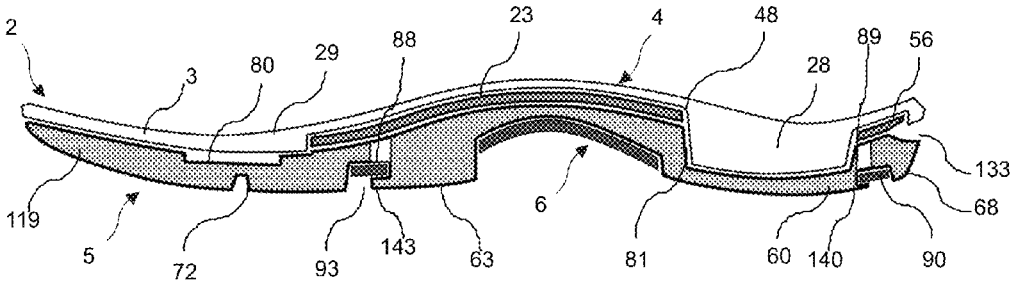
FIG. 25 is an assembled, center cross-sectional view of the present invention with secondary arch flex inserts captured by landing blocks taken along line 25-25 of FIG. 23.

FIG. 23 shows the assembled bottom view of the sole system 2 in an unloaded state. FIG. 24 shows a cross-section of an alternative outsole design 119 containing molded in undercut tabs 141 and 142 at the outer edges of the landing blocks 61 and 62 to partly capture the secondary arch flex device 6 taken along line 24-24 of FIG. 23. FIG. 25 is an assembled, center cut cross-section view is shown of an alternative outsole design 119 containing molded in undercut tabs 140 and 143 at the outer edges of the landing blocks 60 and 63 to partly capture the secondary arch flex device 6 taken along line 25-25 of FIG. 23.

Figure 26:
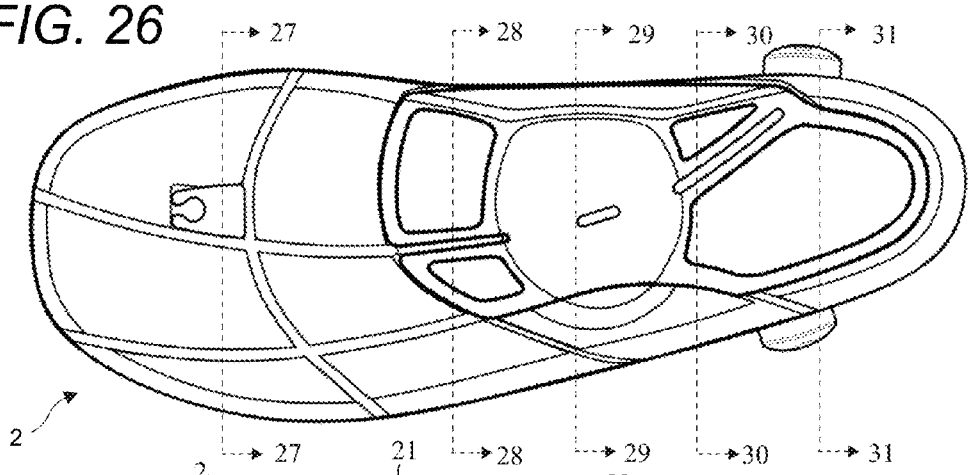
FIG. 26 shows the assembled bottom view according to the present invention.
Figure 27:
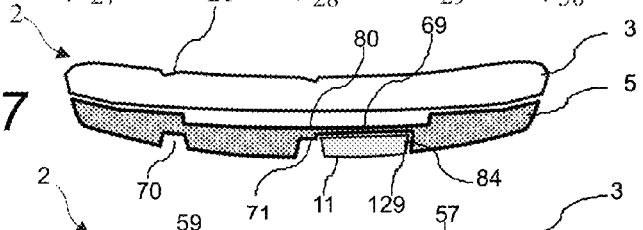
FIG. 27 is a cross-sectional view of the forefoot region of the assembled footwear, according present invention, taken along line 27-27 of FIG. 26.
Figure 28:
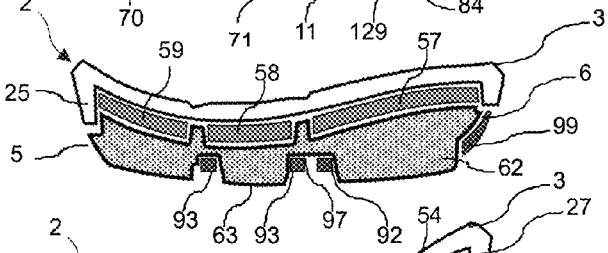
FIG. 28 is a cross-sectional view of the mid foot region of the assembled footwear, according present invention, taken along line 28-28 of FIG. 26.
Figure 29:
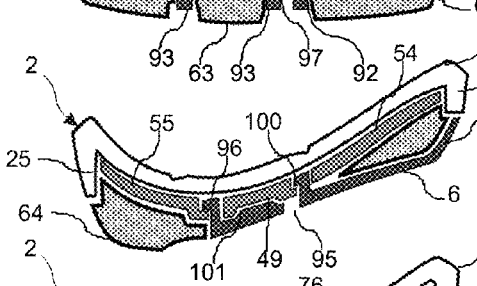
FIG. 29 is a cross-sectional view of the mid foot center region of the assembled footwear, according present invention, taken along line 29-29 of FIG. 26.
Figure 30:
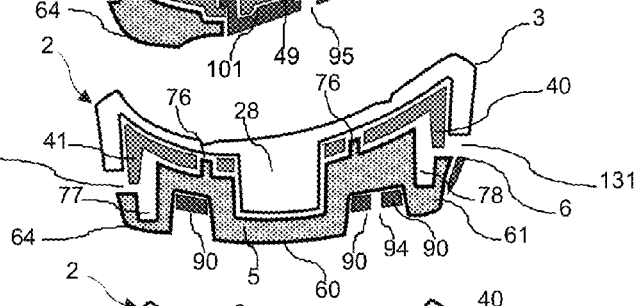
FIG. 30 is a cross-sectional view of the mid foot region of the assembled footwear, according present invention, taken along line 30-30 of FIG. 26.

FIG. 26 shows the assembled bottom view of the sole system 2 in an unloaded state. FIG. 27 shows an assembled, forefoot cross-section view through the toe loop stabilizer base 11, taken along line 27-27 of FIG. 26. FIG. 28 is an assembled, mid foot cross-section view of the present invention through the frontal landing blocks 62 and 63, taken along line 28-28 of FIG. 26. FIG. 29 is an assembled, mid foot center cross-section view showing the interlocking tabs 96 and 100 of the secondary arch flex device 6 inserted and locking with the slots 42 and 43 formed into the arch flex device 4, taken along line 29-29 of FIG. 26. FIG. 30 is an assembled, mid foot cross-section view through the rear landing blocks 60 and 61 taken along line 30-30 of FIG. 26. FIG.

31 is an assembled cross-section view through the heel landing block 60 and with sliding blocks 7 installed, taken along line 31-31 of FIG. 26.

Figure 32:
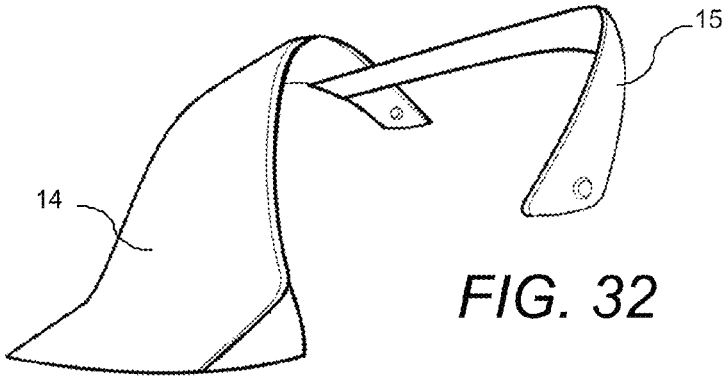
FIG. 32 is a front three quarter view of an alternative upper strap layout design for the present invention.
Figure 33:
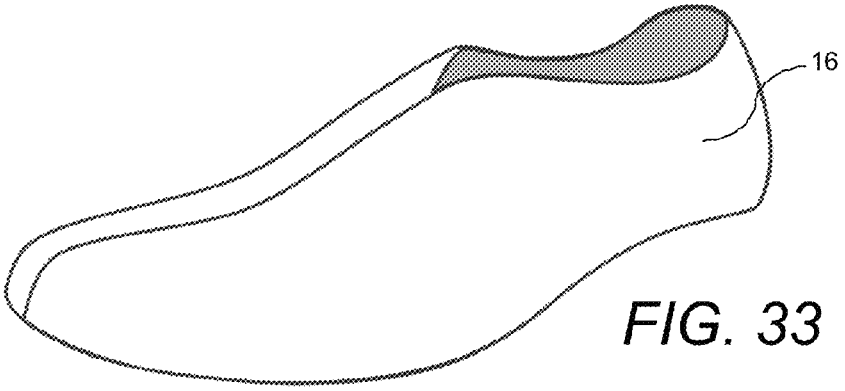
FIG. 33 is a front three quarter view of an alternative upper design for the present invention.
Figure 34:
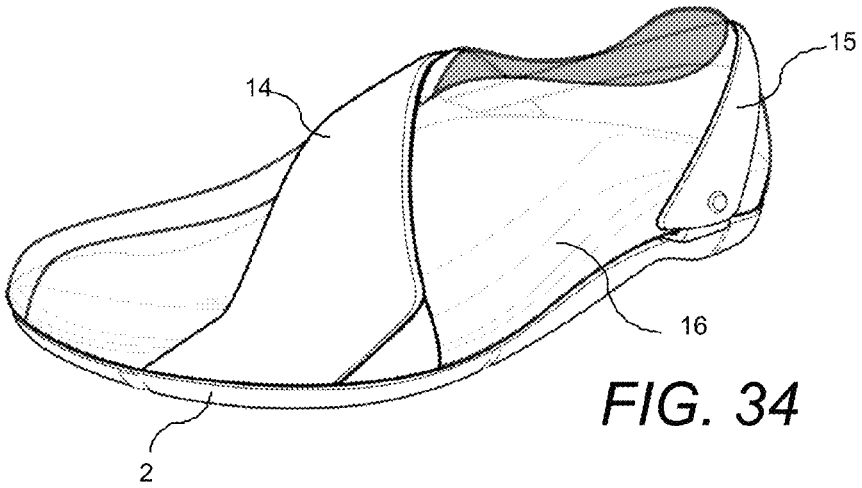
FIG. 34 is an assembled front three quarter view of an alternative upper design for the present invention.

FIG. 32 is a front three quarter cross-sectional view of an alternative upper strap layout design 14 and 15 to be used with a full upper design 16. FIG. 33 is a front three quarter view of a full upper design 16 covering the top surfaces of wearer's foot. FIG. 34 is an assembled front three quarter view of a full upper design 16 with the sole system 2 while utilizing the alternative upper straps 14 and 15 to adjust to and secure wearer's foot to the footwear.

Figure 35:
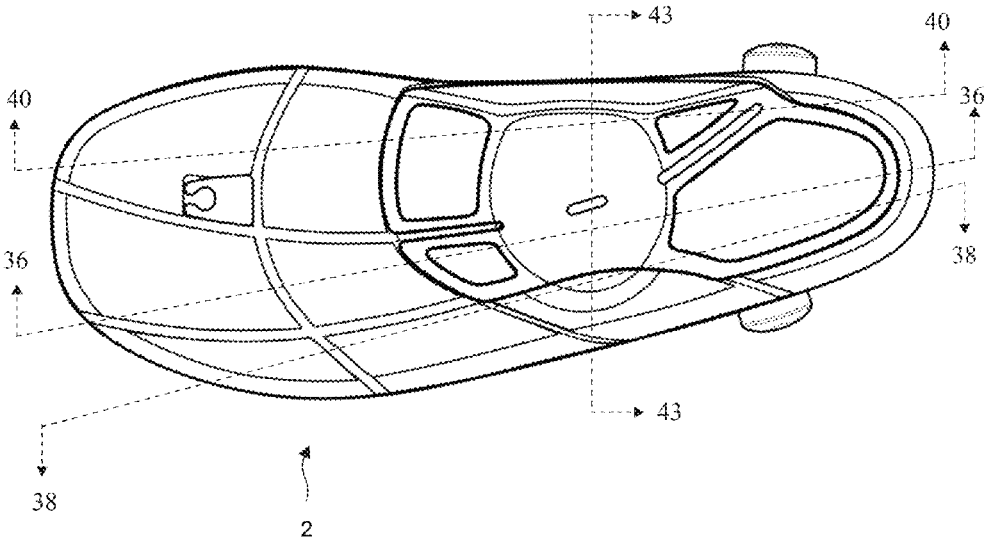
FIG. 35 shows a bottom view of the assembled footwear according to the present invention.
Figure 36:
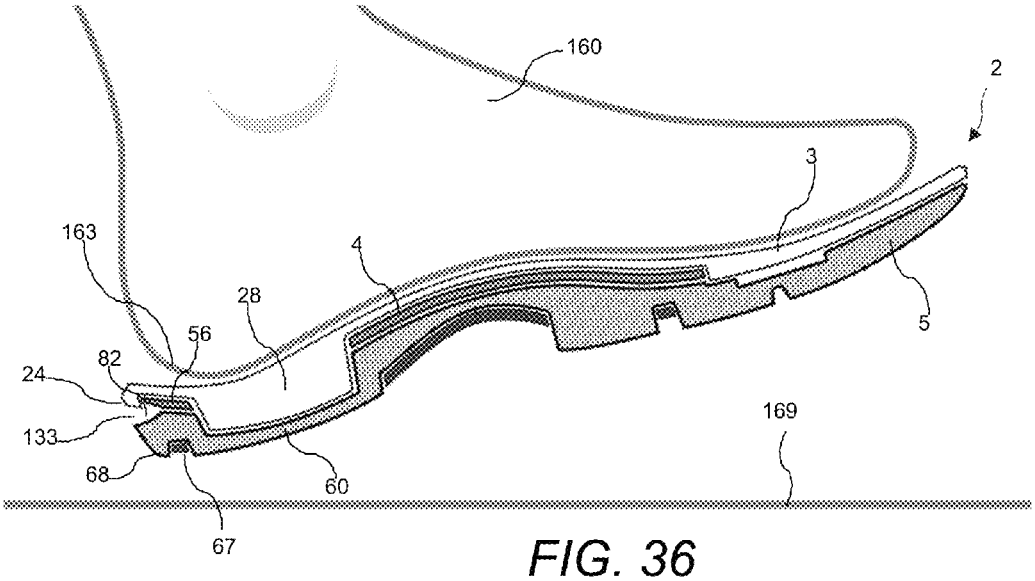
FIG. 36 shows the foot and sole system according to the present invention ready to make contact with a ground plane.
Figure 37:
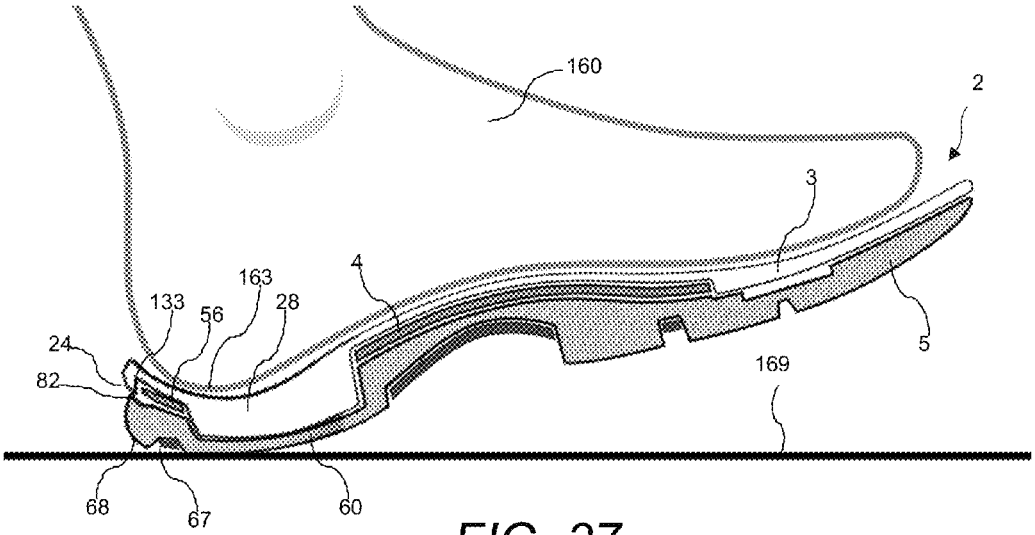
FIG. 37 shows the foot and sole system according to the present invention making initial contact with the ground plane.

FIG. 35 shows the assembled bottom view of the sole system 2 in an unloaded state with multiple cross-sections taken to show the supportive movements of the sole system 2 during a gait cycle. FIG. 36 shows a cross sectional view taken along line 36-36 of FIG. 35, of the foot 150 and sole system 2 ready to make contact with the ground plane 169. FIG. 37 is a cross sectional view taken along line 36-36 of FIG. 35, of the initial heel strike of the foot 150 shown with the components of the sole system 2 reacting to the force applied by the heel 163.

Figure 38:
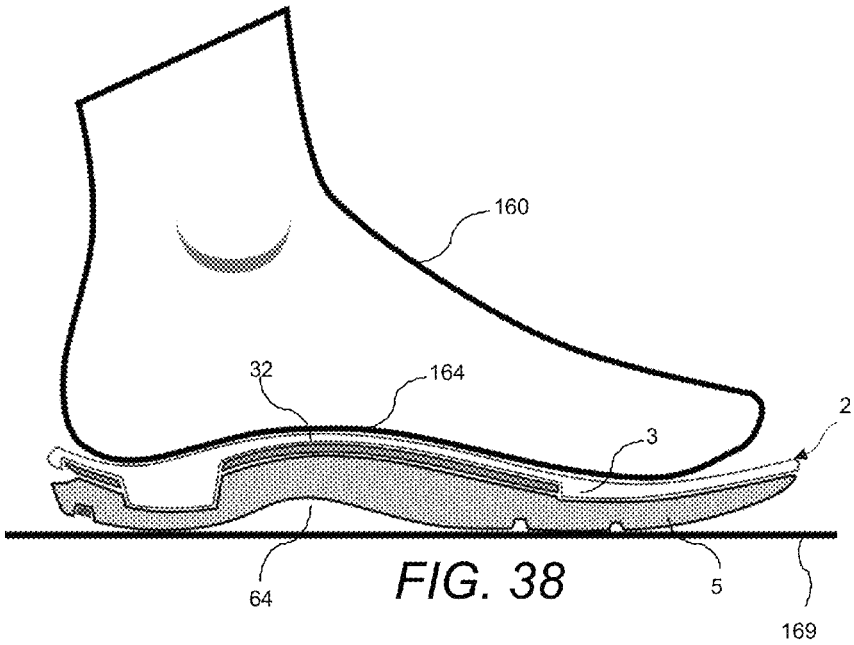
FIG. 38 shows the foot and sole system according to the present invention in an unloaded state.
Figure 39:
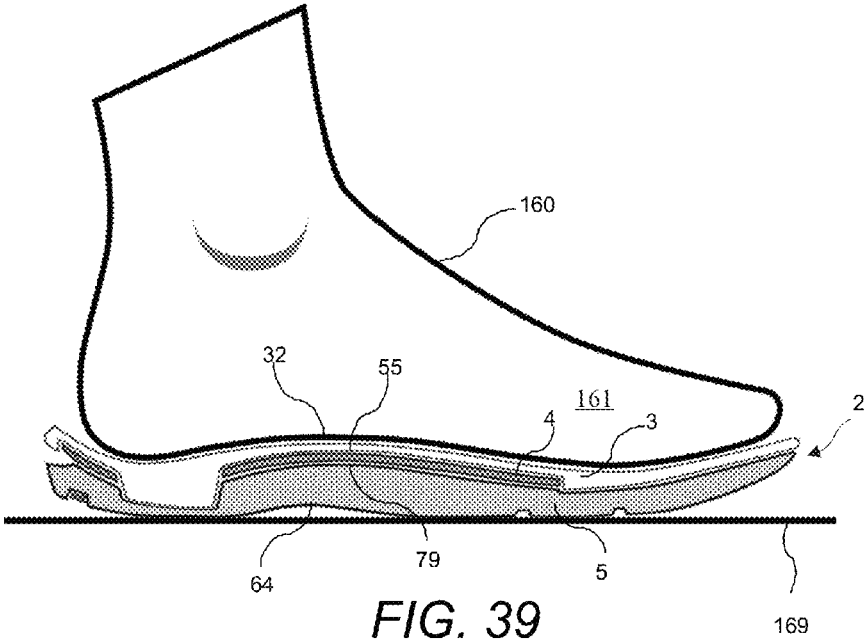
FIG. 39 shows the sole system according to the present invention as it compresses onto the ground plane as an initial weight applied to the lateral side thereof.

FIGS. 38 and 39 show lateral cross sectional views, taken along line 38-38 of FIG. 35, of the first stage of the mid foot compression. In FIG. 38 the foot 150 and sole system 2 are shown in an unloaded state. FIG. 39 shows the initial weight from the foot 150 is applied to the lateral side of the sole system 2 as it compresses onto the ground plane 169.

Figure 40:
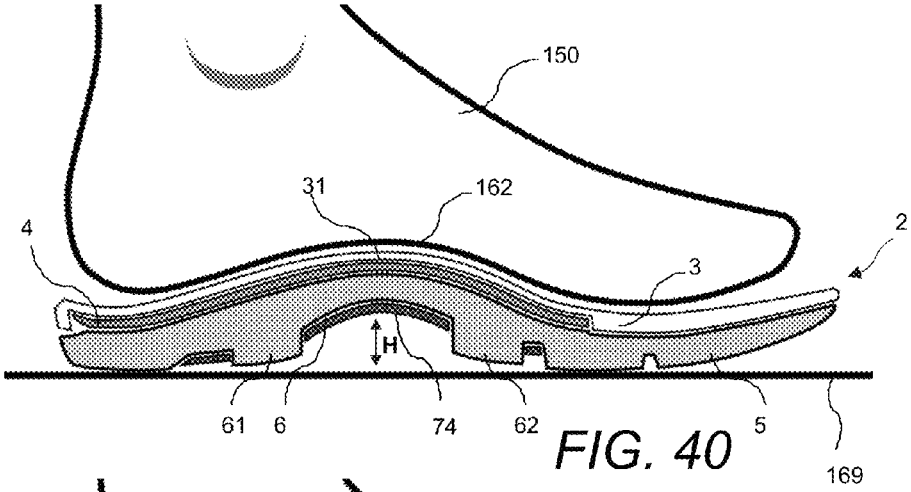
FIG. 40 shows the foot and sole system according to the present invention in an unloaded state.
Figure 41:
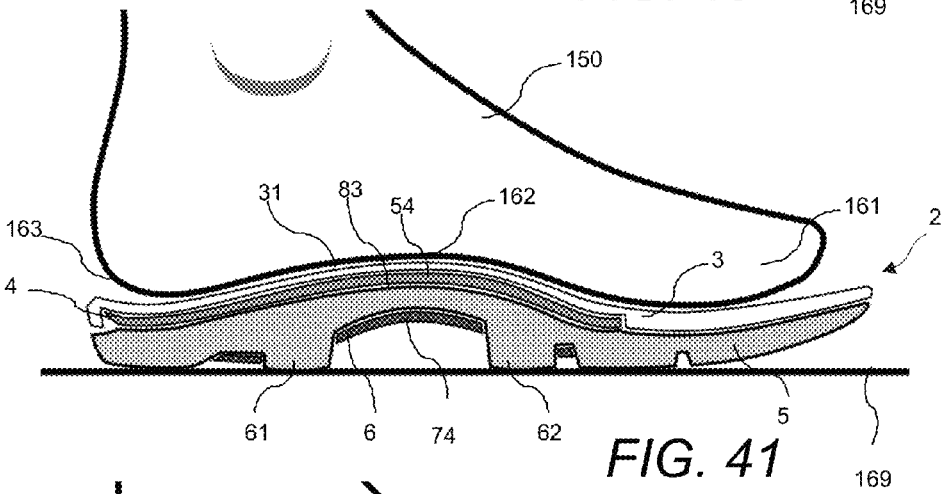
FIG. 41 shows the foot and sole system according to the present invention as an initial weight from the foot applied to the medial side of the sole system.
Figure 42:
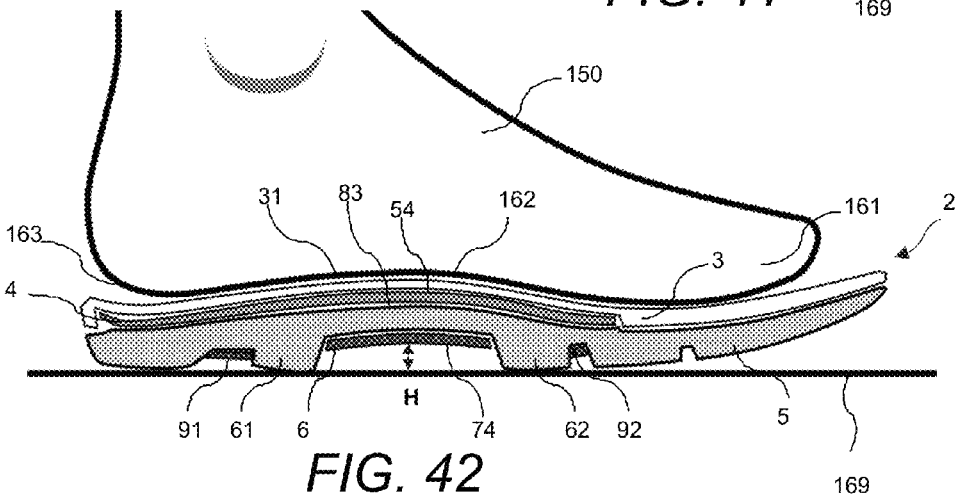
FIG. 42 shows the foot and sole system according to the present invention as a full medial compression being applied onto the sole system.

FIGS. 40-42 are medial cross-section views, taken along line 40-40 of FIG. 35, showing the second stage of the mid foot compression. In FIG. 40, the foot 150 and sole system 2 is shown in an unloaded state. In FIG. 41, the initial weight from the foot 150 is applied to the medial side of the sole system 2 as the landing blocks 61 and 62 compresses onto the ground plane 169. In FIG. 42 the full medial compression is shown with full weight of the foot 150 being applied onto the sole system 2.

Figure 43:
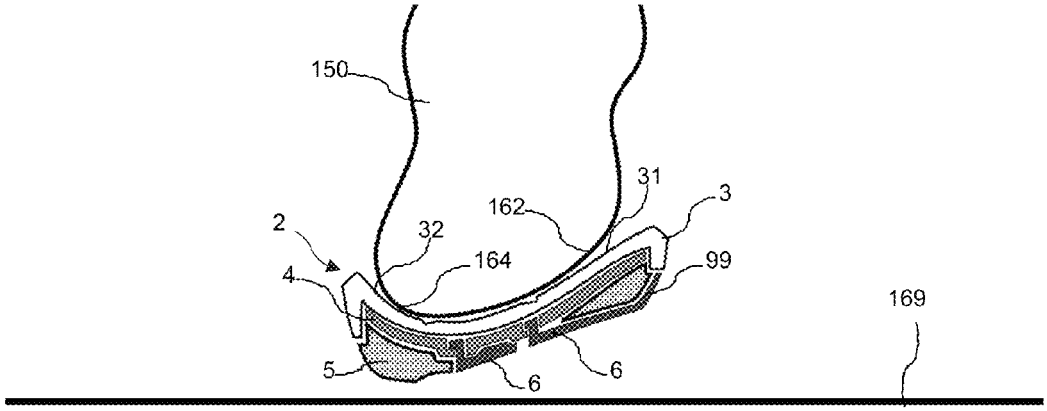
FIG. 43 shows a lateral cross-sectional view of the center of the mid foot region of the sole system according to the present invention in an unloaded state.
Figure 44:
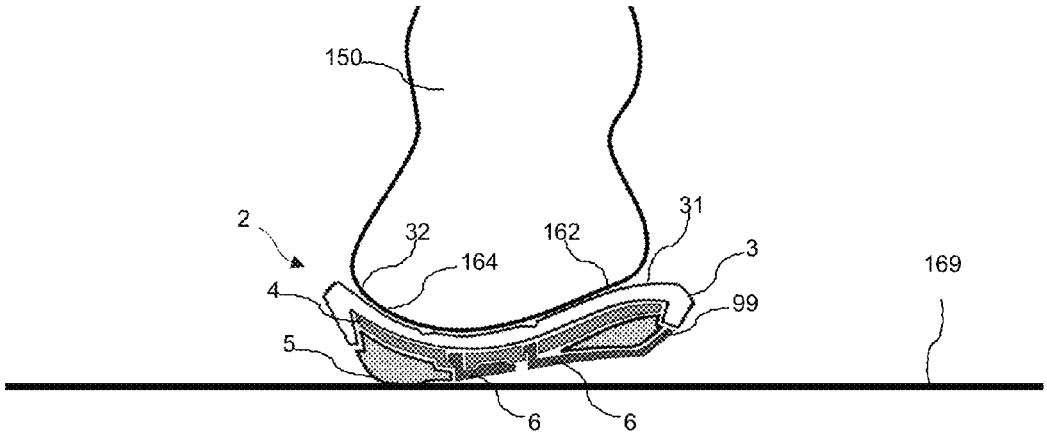
FIG. 44 shows a lateral cross-sectional view of the center of the mid foot region of the sole system according to the present invention in a loaded compressed state.

FIGS. 43-44 show the lateral cross-section drawings center of the mid foot region correlating with the forces applied from FIG. 38-42 onto the sole system 2, taken along line 43-43 of FIG. 35. FIG. 43 is shown in an unloaded state while FIG. 44 is shown in a loaded compressed state.

Figure 45:
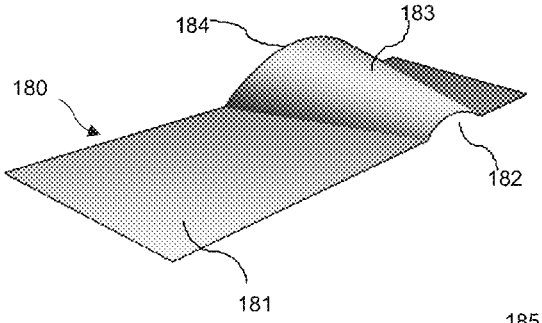
FIG. 45 is a drawing of a surface illustrating the sole system according to the present invention in an unloaded state.
Figure 46:
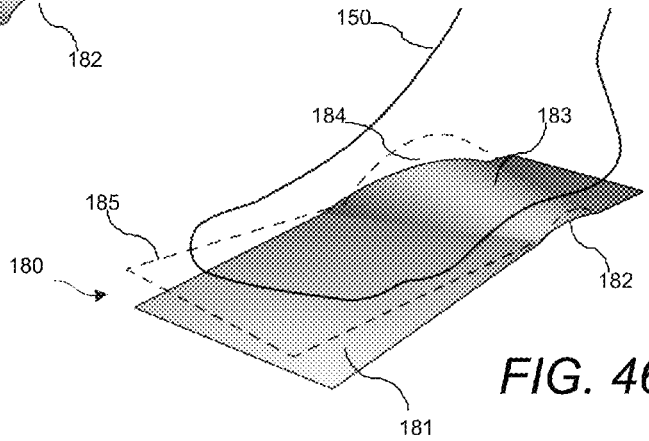
FIG. 46 is a drawing of a surface shown in a loaded state illustrating how the sole system according to the present invention transforms compression force into pivoting adduction motions.

FIGS. 45 and 46 show how the sole system 2 transforms compression force of the foot 150 into pivoting adduction motions, represented by surface 180. FIG. 45 is shown in an unloaded state while FIG. 46 is shown in a loaded compressed state.

Figure 47:
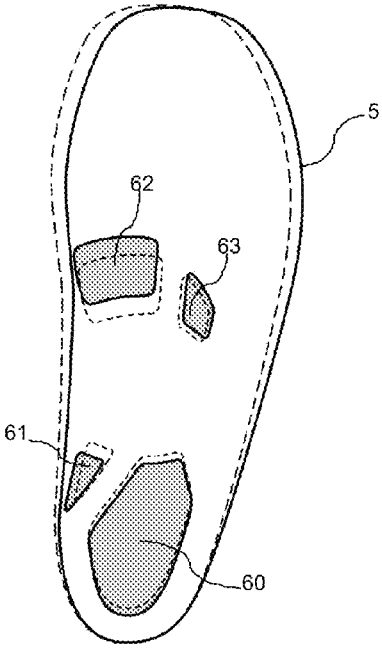
FIG. 47 illustrates pivoting motion of the sole system according to the present invention, with the expansion movements of landing blocks.
Figure 48:
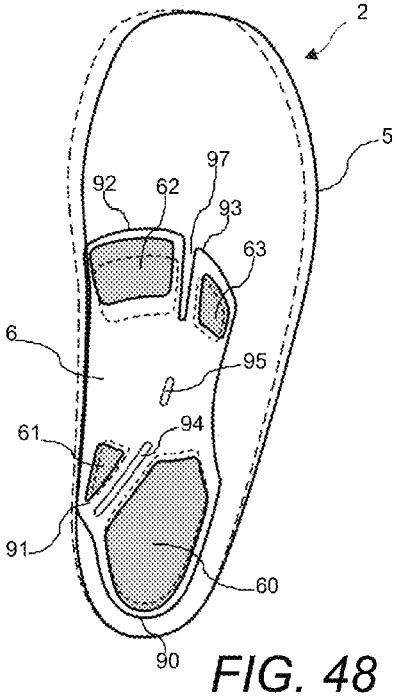
FIG. 48 illustrates pivoting motion of the sole system according to the present invention, with the expansion movements of landing blocks controlled by the secondary arch flex device.

FIGS. 47 and 48 show the pivoting motion of the sole system 2 from the bottom view. FIG. 47 is the sole system 2 pivoting motion with the expansion movements of landing blocks 60-63. FIG. 48 is the sole system 2 pivoting motion with the expansion movements of landing blocks 60-63 controlled by the secondary arch-flex device 6.

Each specific function of the sole system 2, as it relates to the stages of the gait cycle, are now described to better understand the purpose of the design. Each stage of the gait cycle is described above in FIG. 4A-4E, FIG. 5A-5C and FIG. 6A 6C illustrating the sequence of a foot's movements. These movements are met with the dynamic support of the sole system 2. Now we may examine how each component of the sole system 2 corresponds to the pronatory support requirements of the foot. This can be shown by using multiple cut cross-section drawings indicated in FIG. 35 and FIG. 45-48 to describe the dynamic supportive movement of sole system 2.

FIG. 36 shows the foot 150 and the center longitudinal cross-section drawings of sole system 2 suspended just above the ground plane 169 without any forces exerted on the footwear 1. In FIG. 37 the first initial contact is made as the heel 163 strikes the ground. The bottom outsole 5 rounded heel rim 68 is designed with a channel 67 allowing upward deflection into the rear heel 24 portion on the midsole 3. A rear heel opening space 133 created by an upward arch of the midsole 3 separates the midsole 3 from the outsole 5 at a rear of the sole system 2 to create a rear heel open space 133 across most of the width of the rear of the sole system 2 to allow converging movement of the midsole 3 and outsole 5 at the rear of the sole system 2. The rear heel open space 133 extends from the heel edge of midsole 3 allows for upward deflection of the heel lip 82 thus absorbing the initial heel strike impact. Meanwhile, the heel 163 of the foot 150 is insulated from the impact by the heel cup region 56 on the arch flex orthotic device 4. As the heel 163 rolls forward onto the heel landing block 60, weight is more evenly distributed by a deep rounded heel cup 33 of the midsole 3. To further absorb the heel weight, a localized midsole 3 heel cushioned block 28 is incorporated onto a heel region 3*b* (see FIG. 13A) of midsole 3.

FIG. 38 shows the lateral cross-section and the foot 150 as it rolls forward after the initial heel strike, as the fore foot makes contact with the ground plane 169. Although still in an unloaded state, the mid foot region 164 of the foot 150 is fully supported by the lateral arch surface 32 of the midsole 3. The curvature of support runs laterally and longitudinally across the mid foot cross-section of the midsole 3 to mimic mid foot contours in a natural unloaded state.

FIG. 39 shows the weight of the foot 150 transferred to the lateral mid foot arch 164 and the fore foot 161 after the heel strike. This marks the first stage of mid foot compression resistance of the sole system 2. Due to the high lateral arch support provided by the lateral arch surface 32, the compressive down force can be directly transferred down through the corresponding lateral arch surface 55 of the arch flex device 4 and the raised mid foot lateral arch surfaces 79. The force is dampened by the stage resistance feature designed as a collapsible concave arched cavity 64 to engage the ground. This concave arched cavity 64 is formed onto the lateral arch side of the bottom outsole 5 where it's utilized as a collapsible space to allow unsupported compression. The resistance is met by the flexion of the sole system 2. The combined layers of the sole system 2 include midsole 3, arch flex device 4, and outsole 5 which provide degrees of flexible resistance tunable by the choice of materials used by each component in production.

The support and resistance in the medial arch 162 of the foot comes from the four landing blocks 60-63 formed onto the mid foot arch cavity 74 of the bottom outsole 5 shown in FIGS. 9,10,12, 15A, 15C and 40-42. The heel landing block 60 serves as an anchor to the outsole 5 as weight has already been applied to the heel 163. In FIG. 9 shown as a bottom view, the rear medial landing block 61 is located at the rear base of the medial arch. The two frontal landing blocks 62 and 63 are located at the front base of the medial arch formed as a center mid foot landing block 63 and an outer landing block 62. The four blocks 60-63 can serve as a support for the medial arch when full downward force is applied.

FIGS. 40-42 show second stage medial cross-sectional side views of the foot 150 and sole system 2 after the initial first stage compression with the ground plane 169. Although still in a unloaded state, FIG. 40 shows medial arch 162 of the foot 150 is fully supported by the lateral arch surface 32 of the midsole 3. The beginning of the second stage medial compression is met with low resistance because the mid foot landing blocks 61 and 62 of the sole system 2 are unsupported by the ground plane 169. This is first due to the landing block 61 and 62 being suspended just above the ground plane 169 in an unloaded state and then to the contact faces of the landing blocks 61 and 62 formed in an upward angle toward the mid foot arch center. The high concave surface of the mid foot arch cavity 74 formed onto the outsole 5 allows the medial arch 162 of the foot 150 to compress downward before the landing blocks 61 and 62 contact the ground plane 169. This allows a lower resistance travel in the initial downward mid foot compression having no direct contact and support by the ground plane 169. The resistance is met only by the combined layers of the sole system 2 including a midsole 3, an arch flex device 4, an outsole 5, and a secondary arch flex device 6 which provide a degree of flexible resistance tunable by the choice of materials used by each component in production.

FIG. 41 shows the weight of the body transferred from the lateral side 164 to the medial side 162 of the foot 150 continuing the second stage mid foot compression of the sole system 2. As full mid foot compression begins, the angled up face of the landing blocks 61 and 62 compress down making full contact with the ground plane 169. The lateral arch 164 and medial arch 162 are now compressed by the weight of the body as fore foot 161 and heel 163 absorb the majority of the load. The high curvature that runs laterally and longitudinally across the mid foot cross-section of the footwear enables the contours 31 of the midsole 3 to meet up to the medial arch 162 to engage support as soon as any weight is applied to the mid foot. Due to the high medial arch support of 31, the compressive down force is captured and transferred immediately and directly down through the corresponding arch flex device medial arch support surface 54 and the top medial arch surface 83 of the outsole 5.

FIG. 42 shows the landing blocks 61 and 62 fully compressed onto the ground plane as full weight transfer to the mid foot is achieved. The sole system 2 is now supporting the bodyweight of the wearer. Now the landing blocks 61 and 62 are directly supporting the mid foot to stabilize the mid foot zone and allow for increased compression resistance of the medial arch. The mid foot region can now be tasked to support more of the load while redistributing some weight off the fore foot 161 and heel 163 region.

The height H of the medial arch can be seen in FIG. 40 in an unloaded state and in FIG. 42 in a fully compressed state. The height H can vary be between 5 mm to 25 mm according to wearer's shoe size. The height H in FIG. 40 can be taken from the highest point in the mid foot arch cavity 74 of the outsole 5 down to the horizontal ground plane 169. As a byproduct of the full mid foot compression in FIG. 42, the landing blocks 61 and 62 can be seen spreading apart and away from the center of the mid foot arch cavity 74.

In a preferred embodiment of the present invention, full mid foot compression resistance can be further controlled by the use of a secondary arch flex device 6 as shown in detail on FIG. 16A-16D. The secondary arch flex device 6 can be seen in the cross-section drawings FIG. 40-42 embedded up within the mid foot arch cavity 74 of the outsole 5 and anchored around the landing blocks 61 and 62. The secondary arch flex device 6 is made to attach and capture all of the flex control landing blocks 60-63 on the bottom outsole 5's shown in FIGS. 9, 10, 12, and 48. The secondary arch flex device 6 adds to the resistance forces transferred down through the midsole 3 and arch flex device 4 onto the mid foot region of outsole 5. The mid foot arch cavity 74 of outsole 5 is then forced to compress downward into the empty space, forcing the landing blocks 60-63 outward, pushing and spreading them apart in the horizontal plane as an aforementioned byproduct of the full mid foot compression.

FIG. 42 shows the downward compression force in the mid foot effectively transforming into a horizontal expansion force by the landing blocks 61 and 62 in this side cross-section view. This expansion motion can also be seen from bottom plan view in FIGS. 47 and 48. The secondary arch flex device 6 can be seen capturing and connecting the mid foot landing blocks 61 and 62 on the medial arch side in FIG. 40-42 with its corresponding support ribs 91 and 92. The support ribs 91 and 92 restrict the expansion and deflection rate of landing blocks 61 and 62 as shown in FIG. 42. The level of restriction creates an added progressive resistance in the mid foot region from the compressive down forces of the foot.

The downward mid foot compression forces of the foot 150 are generally transferred from the lateral side 164 to the medial side 162 shown in FIG. 5A-5C and FIGS. 6A-6C. The sole system 2 can also be made with a progressively increased resistance in compression from the lateral side to the medial side. Mimicking the transfer of mid foot forces can provide a smooth transition of support across the mid foot region in a gait cycle.

FIG. 43 shows a mid foot lateral cross-section 165 resting atop of the center drawing of the sole system 2 in an unloaded state. To achieve a laterally increased compression in the medial arch, the secondary arch flex device 6 can include a ridge on the medial side extending upward forming a medial arch wall 99. This can be seen with detail in FIG. 16A-16D showing the medial arch wall 99 structure connected and reinforced to the outer sides of the medial landing blocks 61 and 62 while providing overall increased rigidity for the secondary arch flex device 6.

This increased rigidity on the medial sides of the secondary arch-flex device 6 create a decreased rigidity toward the lateral side therefore forming a transitional compression resistance that can be progressively increased from the lateral to the medial side. The medial arch wall 99 structure can also be increased or decreased in thickness to achieve a desired level of medial resistance needed for the wearer.

FIG. 43 shows a cross-sectional view of the sole system 2 without weight transfer from the mid foot regions 162 and 164 of mid foot section 165. FIG. 44 shows a cross-sectional view of the deflection of medial 31 and lateral 32 lateral arch surfaces of the sole system 2 resisting the outward expansion of the foot 150, thus converting the downward force into a lateral sideways expansion forces to reduce weight exerted on the foot 150.

When the downward compression force is applied to the mid foot region, the foot's 150 pivoting motions of adduction are captured and further enhanced by the sole system 2. The pivoting motion created by the mid foot is described by a surface 180 in FIGS. 45 and 46 simplified to illustrate the effect of ground engaging surfaces of the outsole 5. In FIGS. 45 and 46 a bottom surface of the outsole 5 is shown as a plane surface following a raised arched portion at mid foot region 183. A raised arch mid foot region 183 has a larger and higher medial arch opening 184 compare to the smaller and lower lateral side arch opening 182. The higher medial arch opening 184 allows the medial arch compression aforementioned in FIGS. 40-44. The lower lateral arch opening 182 is made for the lateral arch compression described above in FIGS. 38 and 39.

FIG. 46 shows the weight of the foot 150 being applied onto the surface 180 by compressing down onto the mid foot raised arches 183 causing the higher medial arch opening 184 to collapse and extend forward. The lateral side arch opening 182 is smaller and has less forward extension thus causing the forefoot portion 181 of the basic surface 180 to pivot outward in adduction. This outward pivot direction turns away from the medial side and shifts towards the lateral side like the motions of adduction described above in FIGS. 2C and 5C.

However, this system can also pivot by only having a medial arch opening 184 without a raised lateral arch opening 182. The dotted line 185 represents the original non-compressed position of the basic surface showing the pivoting movement.

As the byproduct of biomechanical mid foot compression movement due to the full weight transfer onto the foot 150, the forefoot 154 and 161 pivot out as it pronates in adduction. This can be seen from the horizontal and frontal plain described above in FIGS. 2C, 3C, 5C and 6C. The same ability in pivoting of the forefoot can also be incorporated into movements of the sole system 2 shown in FIGS. 47 and 48 in bottom plan views. In general, the rear heel landing block 60 is firmly planted on the ground plane as the mid foot arch collapses and the forefoot region pivots out in adduction. This biomechanical deflection effect from the mid foot compression enables the sole system 2 to move with the foot in directional flex (i.e., pivoting). The amount of forefoot directional flex motion pivoting in adduction under load can be seen in FIG. 47 as a solid outline. An unloaded sole system 2 in its original position is shown with dotted lines.

FIG. 47 also shows the expansion movement of the outsole 5's landing blocks 60-63 from the bottom plan view. The unloaded, original position of the blocks 60-63 is represented in dotted lines and the fully compressed position in solid lines.

The movement of the landing blocks 60-63 is captured by the secondary arch flex device 6 shown in FIG. 48. The secondary arch flex device 6 stabilizes and controls the horizontal expansion movements between the landing blocks 60-63 while providing a vertical compressive resistance in the mid foot region shown in FIG. 40-42. The expansion and compressions of the device are controlled laterally and longitudinally across the mid foot shown in unloaded, original position as represented in dotted lines and the fully compressed position in solid lines. The amount of the resistance in expansion rate can be tuned by adjusting the overall thickness of the secondary arch flex device 6 as well as the size of the support ribs 90-93 capturing the landing blocks 60-63. Individual resistance between and across the landing blocks can also be adjusted by independently varying the sizes of the formed slots 94, 95 and 97.

The ability for the sole system 2 to pivot with mid foot compression lies in the mid foot arch cavity 74 and lower lateral arch cavity 64 design of the outsole 5 shown in FIG. 15C. The longitudinal flex groove 70 formed into the bottom outsole 5 also assist in the directional flex along with the slots and grooves 42-47 formed into the arch flex device 4. Slots 94, 95 and 97 shown in FIGS. 16B and 16C formed into the secondary arch flex device 6 can also aid in flexion of the sole system 2. The outsole 5 and midsole 3 both serve as an enabling hinge with raised medial and lateral arches to direct the adduction's pivoting motions described by surface 180 in FIGS. 45 and 46. The arch flex orthotic device 4 along with the bottom secondary arch flex device 6 serves to control and offers resistance in the pivoting movements. Combined together sole system 2 forms a system of a resilient support bed to move with exact biomechanical motions of the foot 150 to achieve progressive resistance in directional flex.

FIG. 13A-13C shows the midsole 3 if the sole system 2. The midsole 3 serves as the main contact surface for the foot. The midsole 3 is formed with a top surface 13*a* having contours to mimic the natural shape of the foot at rest, and starts with a deep spherical cup 33 to provide the heel with uniform support. The deep concave curvature then flows forward and wraps up toward the medial 31 and lateral 32 arch sides. The contours then flatten out toward the forefoot region 34 with a slight concave surface shown as the cut cross-section in FIG. 27. Formed into the midsole 3 is a continuous flex groove 21 that runs longitudinally across the top surface of the midsole 3. The groove first wraps around the perimeters of the heel contour 33 and then dive in toward the mid foot center between arches 31 and 32. The medial flex groove flows into the forefoot between the second and third Metatarsals positions, while the lateral arch groove flows between the 4th and 5th Metatarsals positions. The grooves then connect at the forefoot region 34 biasing towards the lateral side. The purpose of groove 21 is to serve as a functional flexing hinge for the medial 32 and 31 lateral arches as they compress in pronation. The groove 21 also serves as a design motif and a means to channel air under the foot for venting purposes. The beveled groove cross-section also allows additional midsole liner to be embedded deeper into the midsole in making the liner material edge more flush with the midsole. A through slot 22 is formed at the forefoot region 34 for the attachment and passage of the upper strap 8 and toe loop stabilizer base 11.

The underside of the midsole 3 is formed with various features to combine with the arch flex orthotic device 4 and the bottom outsole 5 shown in FIGS. 13A and 13C. In general, the midsole 3 is formed with softer compound material compared with the bottom outsole 5 for better foot comfort. To fully utilize the additional cushioning properties of the softer material selection for the midsole 3, a thick heel cushioning block 28 may be added to the midsole 3 heel region to enable deeper compressible travel for the heel. More energy absorbent material different than that of the midsole 3 may also be used in the heel cushioning block 28 as it requires the block to be a separate part or to utilize dual material molding techniques. The heel cushioning block 28 may also provide methods of attachment for the arch flex device 4 and outsole 5. The forefoot region 34 of the midsole 3 may also be formed with a thicker cross section in the midsole 3 to provide better cushioning for the fore foot 161. A cavity 23 shown in FIG. 13C of a second elevation underneath is formed into the bottom of the midsole 3 to house the arch flex orthotic device 4. Walls 24-26 are formed along the perimeters of the cavity to conceal the arch flex device 4.

The arched up cross-section 24 in the rear heel region in FIGS. 13A and 13C exposes the heel cup portion 56 (see FIG. 36) of the arch flex device 4 making the heel cup portion 56 visible from the rear view. The arch up wall 24 (see FIGS. 36 and 37) also provides space for the bottom heel lip 68 of the outsole 5 to deflect up into the midsole 3.

To achieve progressive resistance for directional flex of the foot 150, the present invention utilizes the mid foot arch flex orthotic device 4 embedded between the midsole 3 and the bottom outsole 5 to fully support the weight of the foot 150. Shown in multiple views in FIGS. 14A-14D, the arch flex device 4 covers from the heel region through the mid foot while utilizing the same contoured surface projected directly down from the midsole 3 surfaces. It is generally formed by using injection molding techniques with durable materials resistant to bending and torsional stresses. In addition, the material should retain strength and be pliable at low temperatures. Such materials can include polymers or composite materials that combine a polymer with glass, carbon, or metal fibers. Depending upon weight of the wearer, nylon and other thermoplastic urethane with shore D hardness can be used to provide adequate flexing resistance. The rate of shore D hardness can also be correlated with the shoe size as on average, the weight of a wearer increases as shoe size increase.

The arch flex device 4 is shown in the center longitudinal cross-section view of FIGS. 22, 25 embedded up into the midsole 3's cavity 23 as heel cushioning block 28 inserts through the formed opening at the heel 48 locking the arch flex device 4 into place. The formed opening of arch flex device's 4 of the heel 48 can be of same perimeter shape as the heel cushioning block 28 for a tight pressure fit. The underside of the arch-flex device 4 is fully supported by the surfaces of the bottom outsole 5. Formed through flex slots 42-47 are shown in FIG. 14C on the arch flex device 4 following the same flex grooved 21 design projected down from the midsole 3. Lateral cut cross-section views of the flex slots 42-47 can be seen in FIGS. 28, 29 and 30. The flex slots 44-47 locate and lock to ridges 76 in FIG. 15B from the top of the bottom outsole 5 to ensure synchronized movement of the sole system 2 when assembled.

The open ends of forefoot slots 46 and 47 are shown in FIGS. 14A-14C, placed along with lateral flex groove 35 allows for adduction and independent dorsiflexion movements of the metatarsals in the push off stage of the gait cycle. In addition, the length, width and location of the slots 42-47 openings can also be used to tune flex resistance level along the longitudinal and lateral mid foot regions of the arch flex device 4. The center lateral slot 42 can be formed with additional ledge 50 while the center medial slot 43 can also be formed with an additional ledge 51. Ledge 50 and 51 are made to interlock with the corresponding locking tabs 96 and 100 from the secondary arch flex device 6 seen in FIG. 16A. A docking cavity 49 is formed on the bottom of the arch flex device 4 to connect with the contact pad 101 formed onto top surfaces of the secondary arch flex device 6. The contact pad 101 connecting with the docking cavity 49 can serve as a contact and an adhesion point for the two devices seen in section on FIG. 29. This may also allow the direct transfer of force from the arch flex device 4 down to the secondary arch-flex device 6 while capturing the outsole 5.

In a preferred embodiment of the present invention, tracks 40 and 41 with saw tooth track pattern teeth 53 may be molded as a part of the arch flex device 4. FIGS. 14A-14D show the tracks 40 and 41 generally formed on the bottom outer edges of the device 4 on both the lateral and medial sides of the foot. The track teeth 53 are generally pointed downward toward the ground while the slide block teeth 114 are pointed upward to mate with the track teeth. The tips of the teeth are generally rounded off with the same radius as on either side of the base, repeating the tooth design form a consistent saw tooth track pattern for the slide block 7 to travel on. The slide block 7 can securely lock onto any tooth as detent intervals along the length of the tracks 40 and 41. The length of the track can vary from side to side, stretching from the rear foot toward the mid foot region.

Tracks 40 and 41 of a saw tooth track pattern are designed to provide an adjustable range of travel with detents for the slide block 7 shown in FIG. 17A-17D and FIGS. 18A and 18B. Each tooth 53 of the saw tooth track pattern translates into a position of adjustment available for the slide block 7. The adjustments allowed correspond to the length of the track and number of teeth 53 formed onto the track. The tracks may also follow the perimeter curvature of the arch flex device 4 along the rear foot heel region to gain maximum length of travel for the slide block 7.

The slide blocks 7, as shown in FIG. 17A-17D, are used for adjusting the fit of the upper straps 8 and 16. Utilizing the aforementioned tracks system 40 and 41, the slide block 7 contains an embedded backing wall 111 captured behind the tracks as shown in a cross-sectional view FIG. 31. The embedded backing wall also extends downward into the bottom of slide block trench 77 and 78 of the outsole 5 to capture the slide block 7 and prevent unintentional extraction of the slide block 7 shown in a cross-section view in FIG. 30. The backing wall 111 on the slide block 7 is formed with saw tooth pattern 114 to interlock with the track's teeth 53 of the same design shown in FIGS. 18A and 18B. This feature ensures the slide block 7 stays in place once adjusted. Extending perpendicularly from the embedded backing wall 111 and the base of the teeth 114 is a connecting arm 116. The connecting arm 116 extends out beyond the walls of 25 and 26 from the midsole 3 and outsole 5 ledge of 117 and 118 moving outward along the horizontal plane from the embedded backing wall 111 shown in FIG. 31. The connecting arm 116 is situated in the opening slot 131 created by the gap of midsole 3 and outsole 5. The connecting arm 116 is captured between the top walls of 25 and 26 and the bottom ledge of 117 and 118. The arm 116 then angles upward, running parallel along the midsole side wall of 25 and 26 to form a triangular tab 113 for attachment to the upper straps 8. The triangular tab 113 may contain a through hole 110 to serve as a method of mechanical attachment to the straps 8 by rivets 13 or other fasteners. The slide block 7 can also be of a symmetrical design as in side view FIG. 17D. This allows the same slide block 7 to be used on both lateral and medial sides of tracks 40 and 41.

The rear bases 8*b* of the upper straps 8 are attached to the slide blocks 7 to allow adjusting the upper strap 8 to a desired fit. Therefore, the length of the upper strap 8 can be adjusted by moving the slide block 7 forward or rearward along the tracks 40 and 41 on the sides of the sole system 2. The adjustments are made by pushing the tab 113 of the slide block 7 directly down toward the ground plane. By disengaging the slide block teeth 114 from the track teeth of 53, the slide block 7 is now free to be slid forward or rearward to achieve a desired fit of the upper strap 8. Downward deflection resistance is met from the ledges of 117 and 118 of the outsole 5 when pushing down on the slide block 7 shown in cross-section FIG. 31. The resistance is used to apply constant upward pressure on the connecting arm 116 to keep the slide block 7's teeth fully engaged with the teeth 53 of the tracks 40 and 41. As the downward pressure is released, the outsole ledges of 117 and 118 push up the connecting arm 116 of the slide block 7 to return to its locking position within the track teeth 53. This locking feature ensures the slide block 7 stays in place once adjusted.

The bottom outsole 5 is shown in detail in FIG. 15A-15C. The bottom outsole 5 serves as a structural foundational base engineered to provide initial contact points for engaging the ground surface 169. The ground engaging bottom surface of the outsole 5 conform to the general bottom surface contours of the foot 150. FIG. 15A shows the side view with the bottom surface comprising a convex fore foot 75 and heel 60 region with a concave mid foot arch cavity 64 and 74 raised off the ground plane. This creates a collapsible mid foot region for allowing the lateral arch 64 and mid foot arch cavity to compress. The bottom surface of the outsole 5 is made with general contours similar to a foot's natural unloaded shape to provide the first stage of dampening needed in compressible space of the mid foot aforementioned in FIGS. 45 and 46. The material used to form the outsole 5 can vary from types of thermoplastic urethane rubber to silicone rubber and natural rubber compounds. The level of resistance can be tuned for the wearer by varying the shore A durameter hardness of the bottom outsole 5.

The top surface of the outsole 5 is shown in detail in FIG. 15B as formed heel cavity 81 made for the insertion of heel block 28 of the midsole 3. Locating ridges 76 sit on the raised mid foot lateral arch surfaces 79 and bottom medial arch surface 83. The locating ridge 76 is designed to mate with the formed through flex slots 44-47 from the arch flex device 4 shown in cross-section FIGS. 28 and 30. Formed through holes 65 and 66 near the center of the outsole 5 are used to allow penetration and direct attachment of arch flex orthotic device 4 to the secondary arch-flex device 6. Slide block trenches 77 and 78 are formed into the lateral and medial sides of the rear foot of the outsole 5. It provides a channel for the slide block 7 to travel within as shown in cross-section view FIGS. 30 and 31. Located at the forefoot 75, a rectangular relief 80 is formed to provide a cavity for the attachment of an upper strap 8.

A through hole 85 is formed in the forefoot region 75 for the installation of the toe base 11. Longitudinal flex grooves 70 and 71 are formed into the bottom of outsole 5 with similar curvature as the midsole groove 21 described above. Shown in FIG. 9, the longitudinal flex grooves 70 and 71 can be described as a direct vertically downward projection of the midsole groove 21 through the sole system 2. It serves as a functional flexing hinge for the medial lateral arches of the foot 150 as they compress in pronation. Lateral flex grooves 72 and 73 are also formed in the forefoot region to promote dorsiflexion movements of the metatarsals in the push off stage of the gait cycle from FIG. 4E.

A toe loop stabilizer base cavity 69 is formed around the through hole 85 to embed the base 126 on the bottom of outsole 5 is shown in FIG. 15C while a cross-section view in shown FIG. 27. Landing blocks 60-63 are clearly visible in FIG. 15C as the full block height can be seen due to the absence of secondary arch flex device 6 in the mid foot arch cavity 74 and heel trench 67. An alternative outsole design 119 contains molded in undercut tabs 140 143 at the outer edges of the landing blocks 60-63 to partly capture the secondary arch flex device 6 is shown as cross-sections in FIG. 24 and FIG. 25. The secondary arch flex device 6 can be formed using thermoplastics to be durable and flexible and able to support the weight of the mid foot compression.

The secondary arch flex device 6 is shown in FIG. 16A-16D. The secondary arch flex device 6 is installed up into the bottom outsole cavities 74 and 67 while capturing landing blocks 60-63 shown in FIGS. 9,12, and 48. Locking tabs 96 and 100 shown in FIG. 16A are formed on the top surface of the secondary arch flex device 6 and inserted through the outsole's 5 center opening 65 and 66 to interlock with corresponding slots 42 and 43 of the arch flex device 4 shown in cross-section FIG. 29. The locking tabs 96 and 100 are held in place by ledges 50 and 51. The medial arch wall 99 extends up from the medial side of the secondary arch flex device 6 to provide increased resistance in supporting the second stages of mid foot medial arch compression. This also increases the structural resistance in controlling the lateral and longitudinal movements of the medial landing block 61 and 62 by reinforcing the outer stabilizing ribs of 91 and 92. The medial arch wall 99 can vary in thickness and rigidity to control the compression resistance of the medial arch support. Through slots 94 and 97 formed between the landing blocks 60 and 61 and 62 and 63 can also be incorporated into the secondary arch flex system to promote independent engagement in directional flex while the center through slot can provide snap fit locking tab features to combine with the main midsole arch flex device 4 shown in cut cross-section on FIG. 29.

The secondary arch flex device 6 may be formed using injection molding techniques with durable materials resistant to bending and torsional stresses. In addition, the material should retain strength and be pliable at low temperatures. Such materials can include polymers, composite materials that combine a polymer with glass, carbon, or metal fibers. Depending upon weight of the wearer, nylon and other thermoplastic urethane with shore D hardness can be used to provide adequate flexing resistance. The rate of shore D hardness can also be correlated with the shoe size as on average, the weight of a wearer increases as shoe size increases. The material used in the secondary arch flex device 4 can vary in Shore D hardness and compound as with the secondary arch flex device 6 to maximize the best compression resistance support for the wearer. In general the material used on the secondary device is harder than the arch flex device. Due to the high visibility of the secondary arch flex device 6 shown as assembled view in FIGS. 10 and 12, it can be used as color, trim level, texture, and patterns to coordinate with the color combinations and styles of the upper design. It can also be used as an unique branding motif to represent both style and function as one.

The drawings of toe loop stabilizer 130 are shown in FIG. 19A-19E. The toe loop stabilizer 130 consists of an upper "V" shaped hook 10 and a lower toe loop stabilizer base 11. The upper "V" shaped hook device 10 may contain semi ridged arms 121 to stretch over the tops of each thong type sandal strap 8*a* in FIGS. 10 and 11. The upper "V" shaped hook 10's arms 121 can be molded to conform with the curvature of the forefoot 161 area. The base of the "V" shaped hook 122 starts at the phalanges between the first and second Metatarsal. The two arms 121 of the "V" shaped hooks extend over and around the first and second Metatarsal to hug the contours and curvature of the fore foot 161. The underside base of the "V" shaped hook 10 houses a locking tab 120 to allow attachment to the toe base 11. The upper hook is generally formed by using injection molding techniques with durable materials resistant to bending and torsional stresses. In addition, the material should retain strength and be pliable at low temperatures. Such materials can include polymers, composite materials that combine a polymer with glass, carbon, or metal fibers. Depending upon weight of the wearer, nylon and other thermoplastic urethane with shore D hardness can be used to provide adequate flexing resistance. Due to the high visibility of the upper "V" shaped hook device 10 shown as assembled view in FIGS. 10 and 11, it can be used as color, trim level, texture, and patterns to coordinate with the color combinations and styles of the upper design. It can also be used as an unique branding motif to represent both style and function as one.

The toe loop stabilizer base 11 is also shown in FIGS. 19A-19E. The toe loop stabilizer base 11 comprises a curved tubular toe post 123 to be embedded between the toe loop area of the upper straps 8. Connected at the bottom of the toe post 123 is a base 126 to be mounted underneath the bottom outsole 5's formed cavity 69. Base 126 is symmetrical in design from the bottom view in FIG. 19C. The trapezoidal shape of the base 126 contains a "C" shape opening 127 at the front half of the base 126 while the rear half of the base top surface is connected to the toe post 123. The top of the toe post is formed with an opening 124 to allow the insertion from the locking tab 120 from the "V" shaped hook device 10 as its hook ends snap to the opening of 125 seen in cross-sectional FIG. 19D.

The "C" shape opening 127 of the lower toe loop base 11, at the front half of the base 126, is used to interlock with another base of the same design. The toe loop base 126 is housed within outsole cavity 69, held in place by the beveled wall surfaces 84 around the cavity 69. The walls of toe loop base 129 are also beveled in the same manner to hold the base 126 in place within the cavity 69 shown in cut cross-section view in FIG. 27. When the base 126 feature is released from its outsole cavity 69 it can be rotated 180 degrees and interlocks with a base from the other foot shown in FIG. 19E. Thus combing both the left and the right foot together with outsole facing outsole. This ability mechanically combining both the left and the right foot can prove useful in packaging, storage, and carrying of the footwear in this present.

A cross-section side view to illustrate the locking tab feature 120 from the "V" shaped hook 10 connecting to the toe loop base 126 is shown in FIG. 19D. In final assembly sequence shown in FIGS. 7 and 8, the toe loop stabilizer base 11 is first inserted up through the bottom outsole hole 85 within the toe loop stabilizer base cavity 69. The toe loop stabilizer base 11 is then inserted up through the formed slot on the midsole 3 between the folds of the upper strap 8's toe loop area. The locking tab 120 of the upper "V" shaped hook 10 is then pushed down into the toe post opening 124 to interlock in the opening 125 as both parts lock together as one to form the fore foot toe loop stabilizer 130. The toe loop stabilizer 130 serves as a strap support device with its "V" shaped hook 10 and as a method for vertically hanging the footwear. The toe loop stabilizer 130 also helps to improve forefoot positioning with the footwear 1 as well as having a way to combine the left and right shoe together for storage purposes with a feature on the toe loop stabilizer base 126 seen in FIG. 19E.

FIG. 20 shows the assembled bottom view of the sole system 2. FIG. 21 shows the medial longitudinal cross-section view following the first Metatarsal through the landing blocks 61 and 62. This cross-section drawing shows the arch flex device 4 embedded into the cavity 23 and captured between the midsole 3 and outsole 5. Secondary arch flex device 6 is also shown in FIG. 21 with supporting ribs 92 controlling the forward base of the landing block 62, while the support ribs 91 are shown controlling the rearward base of the landing block 61. The center portion of the secondary arch flex device 6 is shown with an upward arched contour in support of the mid foot arch region.

The profile curvature of the bottom outsole 5 can be seen in FIGS. 21, 22, 24, and 25 with respect to the ground plane 140. Ground engaging surfaces of the landing blocks 61 and 62 are shown suspended, without direct contact or support from the ground plane, allowing the first stage of mid foot compression to be met with less flexion resistance as aforementioned in FIGS. 4C, 5B and 6B. Forefoot lateral groove 72 formed by a surface of second elevation can also be seen in the cross-sectional views.

A longitudinal cut cross-section through the center landing block 63 and heel landing block 60 is shown in FIG. 22. The heel block 28 of the midsole 3 are shown extended down through the heel region of the arch flex device 4, ending within the heel landing block 60 of the outsole 5. The secondary arch flex device 6 is shown in FIG. 22 with support ribs 93 controlling the forward base of the center landing block 63, while the support ribs 90 are shown controlling the rearward base of the heel landing block 60. The center portion of the secondary arch flex device 6 is shown with an upward arched contour in supporting the mid foot arch region. The profile curvature of the outsole 5 can also be seen with respect to the ground plane 140. The ground engaging surface of the center landing block 63 is shown suspended above the ground plane 140 while the forefoot region and heel landing block 60 has direct contact with the ground 140. Rear heel open space 133 can also be seen in FIG. 22 to allow heel edge 68 from the outsole 5 to deflect upward toward the midsole 3 during heel strike. Forefoot cavity 80 formed to house the thong type strap of the upper 8 can also be seen in this cross-section drawing.

FIG. 23 shows the assembled bottom view of the sole system 2 and FIG. 24 shows the medial cross-section view of an alternative embodiment outsole landing blocks 61 and 62 designed to capture the support ribs 91 and 92 of the secondary arch flex device 6. Molded through slots 86 allow an overhanging lip 142 at the forward base of landing block 62 to capture a portion of the support rib 92. This method allows the support rib 92 to be formed with a wider cross-section to increase resiliency in mid foot compression. Molded through slots 87 allow an overhanging lip 141 at the rearward base of landing block 61 to capture a portion of the support rib 91. This method allows the support rib 91 to be formed with a wider cross-section to increase resiliency in mid foot compression. This method of mechanically capturing the support ribs 91 and 92 from the secondary arch flex device 6 ensures the ribs stay in optimum position during all stages of the gait cycle.

An alternative embodiment of the outsole center landing block 63 and heel landing block 60 is designed to capture the support ribs 90 and 93 is shown in FIG. 25. Molded through slots 88 allow an overhanging lip 143 at the forward base of landing block 63 to capture a portion of the support rib 93. This method allows the support rib 93 to be formed with a wider cross-section to increase resiliency in mid foot compression. Molded through slots 89 allow an overhanging lip 140 at the rearward base of the heel landing block 60 to capture a portion of the support rib 90. This method allows the support rib 90 to be formed with a wider cross-section to increase resiliency in mid foot compression. This method of mechanically capturing the support ribs 90 and 93 from the secondary arch flex device 6 ensure the ribs stay in optimum position during all stages of the gait cycle.

FIG. 26 shows the assembled bottom view of the sole system 2. A forefoot cross-section view is shown in FIG. 27 with the toe loop stabilizer base 11. An angled cavity wall 84 with the same angle from the toe post base walls 129 can be seen trapping in the of the toe loop stabilizer base. A surface of a second elevation can also be seen forming the longitudinal flex grooves 70 and 71 while a cavity 80 is formed to embed the upper strap 8 into the outsole 5.

A lateral cross-section through the front landing blocks 62 and 63 is shown in FIG. 28. The arch flex device 4 can be seen captured between the midsole 3 and outsole 5. Cross-sections of the support ribs 93 can be seen secured around the base of the landing block 63, while the support rib 92 and the medial arch wall 99 are secured around the landing block 62. Open slot 97 between the support ribs 92 and 93 allow for independent flexion movements of the landing blocks 62 and 63.

A mid foot center cross-section is shown in FIG. 29 with interlocking tabs from the secondary device 6 attached into arch flex device 4. Locking tabs 96 and 100 attach into the open slots of arch flex device 4 and remain flush with the top surface of the arch flex device 4. Contact pad 101 is connected with the docking cavity 49 in providing a direct physical contact between the two arch flex devices. This can serve as an adhesion point for the two devices by using chemical, physical, or sonic welding methods. By connecting the two devices, this can also allow a direct transfer of force from the arch flex device 4 down into the secondary device 6 and secure the arch flex devices to the outsole 5.

A lateral cross-section through the rear heel landing blocks 60 and 61 is shown in FIG. 30. Heel block 28 from the midsole 3 can be seen extending through the arch flex device 4 in providing the heel with a deep compressible cushioning space. Locating ridge 76 from the outsole 5 can be seen inserted up into the flex slots 44 and 45 of the arch flex device 4. Cross sections of the support ribs 90 can be seen secured around the base of the heel landing block 60, while the support rib 90 and the medial arch wall 99 are secured around the landing block 61. Open slot 94 allows for independent flexion movements of the landing blocks 61. Track sections 40 and 41 from the arch flex device 4 is shown along with the slide block trench 77 and 78 formed into the outsole 5. Open slots 131 between midsole 3 and the outsole 5 allow for a path of travel of the connecting arm 116 of the slide block 7.

Figure 31:
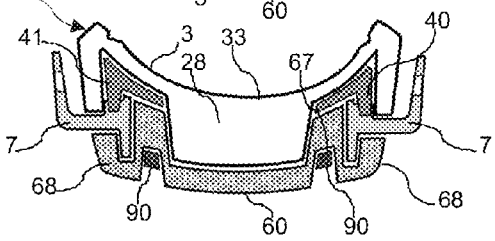
FIG. 31 is a cross-sectional view of the rear foot region of the assembled footwear, according present invention, taken along line 31-31 of FIG. 26.

A lateral cross-section through the rear heel landing blocks 60 and the slide blocks 7 is shown in FIG. 31. Full concave curvature of the heel cup 33 is shown with the heel block 28 of the midsole 3. The slide block 7 is shown captured by tracks 40 and 41 and the outsole trenches 77 and 78. Cross sections of the support ribs 90 can also be seen secured around the base of the heel landing block 60.

FIG. 32 is a front three quarter view of alternative upper straps 14 and 15 that are designed to work with a full upper assembly 16 in securing the wearer's foot 150 to the footwear. This strap system comprises of a front strap 14 and a rear strap 15 made to be adjustable by utilizing the slide block 7 with the embedded track system 40 and 41. The front end of the strap 14 can be attached to the forefoot region on either the medial or lateral side. The rear end of the strap 14 can be connected to a slide block 7 located on the opposite side of the attached front end. This forms an adjustable forefoot strap in holding the front portion of the foot 150 in place. The rear strap 15 can have one end connected to a slide block 7, while the other end can be attached to the front strap 14 on the opposite side. This forms a rear foot adjustable strap in holding the heel portion of the wearer's foot 150 in place.

FIG. 33 is a front three quarter view of a full upper 16 design covering the top surfaces of the foot 150. The full upper 16 can be made by cut and sewn construction from a variety of woven and non woven material. Natural or synthetic materials can also be used in the construction of the full upper 16 although stretchable and breathable material is preferred.

An assembled view of a full upper design is shown in FIG. 34 an with adjustable straps 14 and 15 hugging over the upper 16 in securing the wearer's foot 150 to the footwear. The adjustable straps 14 and 15 are allowed to move freely and independently from the upper 16. Adjustment of the straps is done by sliding the slide blocks 7 attached to the end of the straps forward or rearward to achieve a desired fit. The upper 16 can be attached along the perimeters of the midsole 3 captured between the midsole 3 and outsole 5 of the sole system 2.

The combinations of all the components mentioned in the preferred embodiment of the footwear 1 can work together as a system of progressive compression resistance and directional flex support for the pronatory motions of the foot. The arch flex orthotics devices 4 and 6 combined together with the designed midsole and outsole can form a dynamic sole system 2 to achieve full and even weight distribution of the wearer's foot across the soles. Progressive resistance in the mid foot will also aid in the supenation movements of the foot as new levels of enduring comfort may be provided by the footwear 1. The footwear 1 provides depth and substance as all aspects of the wearer's needs are addressed.

The midsole 3 is preferably made of material having a 15 shore A to 80 Shore A harness, and more preferable made from a material having a 30 shore A to 70 shore A hardness.

The arch flex device 4 is preferably made of material having a 45 shore D to 90 Shore D hardness, and more preferable made from a material having a 60 shore D to 80 shore D hardness, and having a thickness between 2 mm and 8 mm.

The outsole 5 is preferably made of material having a 40 shore A to 90 Shore A harness, and more preferable made from a material having a 60 shore A to 85 shore A hardness.

The secondary arch flex 6 is preferably made of material having a 50 shore D to 100 Shore D harness, and more preferable made from a material having a 70 shore D to 90 shore D hardness, and a thickness between 2 mm to 5 mm Characteristics, functions and advantages of the embodiment in the foregoing invention have been described in detail with drawings to reference the design. However the descriptions and drawings are only illustrative and do not limit the invention to these boundaries. Various combinations and changes to modify the invention may be possible by one skilled in the art without separating from the scope or spirit of the invention.

While the invention herein disclosed has been described by means of specific embodiments and applications thereof, numerous modifications and variations could be made thereto by those skilled in the art without departing from the scope of the invention set forth in the claims.

I claim:

1. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

a single piece integrated arch-flex device (4) residing under at least a portion of the midsole (3) and having a medial arch support surface (54) in contact with the midsole (3) and providing support to the raised medial arch surface (31) of the midsole (3) to maintain the shape of the raised medial arch surface (31) in the unloaded state until sufficient weight is placed on the sole system (2) to tend to flatten the medial arch support surface (54), and a lateral arch surface (55) supporting a lateral arch surface 32 of the midsole (3), the integrated arch-flex device (4) having at least twice the hardness of the midsole (3); and an upper (8) configured to position a foot on the sole system (2) of the footwear (1), wherein said midsole (3) includes a heel block (28) extending downward from the bottom of a heel region of the midsole (3) and through the arch-flex device (4) to provide cushioning in the heel region.

2. The article of claim 1, wherein the integrated arch-flex device (4) supports the midsole (3) to resist pronatory motions of the foot.

3. The article of claim 2, further including a single piece outsole (5) having a general outline of a foot and residing under the midsole and sandwiching the arch flex device (4) between the midsole 3 and the outsole (5), and having a top medial arch surface (83) support under the arch-flex device (4) medial arch support surface (54), the outsole (5) engaging the ground and responding to flexion motions of the foot.

4. The article of claim 3, further including blocks (61-63) formed on the bottom of the outsole (5) before and after the bottom medial arch surface (74), the blocks (61-63) separated from the ground plane in an unloaded state, and contacting the ground plane (169) to further resisting pronatory motions of the foot in a loaded state.

5. The article of claim 4, wherein pronatory motions of the foot is coupled to a separation of the blocks (61-63), and contact of blocks (61-63) with the ground plane separated from the ground plane in an unloaded state (169) resists the separation of the blocks (61-63).

6. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

a single piece integrated arch-flex device (4) supporting the midsole (3) to resist pronatory motions of the foot and residing under at least a portion of the midsole (3) and having a medial arch support surface (54) in contact with the midsole (3) and providing support to the raised medial arch surface (31) of the midsole (3) to maintain the shape of the raised medial arch surface (31) in the unloaded state until sufficient weight is placed on the sole system (2) to tend to flatten the medial arch support surface (54), and a lateral arch surface (55) supporting a lateral arch surface 32 of the midsole (3), the integrated arch-flex device (4) having at least twice the hardness of the midsole (3);

a single piece outsole (5) having a general outline of a foot and residing under the midsole (3) and sandwiching the arch flex device (4) between the midsole (3) and the outsole (5), and having a top medial arch surface (83) support under the arch-flex device (4) medial arch support surface (54), the outsole (5) engaging the ground and responding to flexion motions of the foot;

an upper (8) configured to position a foot on the sole system (2) of the footwear (1); and a secondary arch-flex device (6) attached to the bottom of the outsole (5), the outsole (5) sandwiched between the secondary arch-flex device (6) and the integrated arch-flex device (4), and further supporting the midsole (3) to resist pronatory motions of the foot.

7. The article of claim 6, further including:

including blocks (61-63) formed on the bottom of the outsole (5) before and after the bottom medial arch surface (83), the blocks (61-63) contacting the ground plane (169) to further resisting pronatory motions of the foot, and wherein the blocks (61-63) pass through the secondary arch-flex device (6), and the secondary arch-flex device (6) further resists the spreading of the blocks (61-63).

8. The footwear of claim 1, wherein said the midsole heel block (28) is formed with material different from the midsole (3) to provide energy absorbing cushioning needed in the heel region.

9. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

an integrated arch-flex device (4) residing under at least a portion of the midsole (3) and having a medial arch support surface (54) providing support to the raised medial arch surface (31) of the midsole (3) to maintain the shape of the raised medial arch surface (31) in the unloaded state until sufficient weight is placed on the sole system (2) to tend to flatten the medial arch support surface (54), the integrated arch-flex device (4) having at least twice the hardness of the midsole (3);

an outsole (5) residing under the midsole and sandwiching the arch flex device (4) between the midsole 3 and the outsole (5), and having a bottom medial arch surface (83) under the medial arch support surface (54), the outsole (5) engaging the ground and responding to flexion motions of the foot; and an upper (8) configured to position a foot on the sole system (2) of the footwear (1), wherein said midsole (3) separates from the outsole (5) at a rear of the sole system (2) to create a rear heel open space (133) across most of the width of the rear of the sole system (2) to allow converging movement of the midsole (3) and outsole (5) at the rear of the sole system (2).

10. The footwear of claim 1, wherein said midsole (3) has a localized thick forefoot section equal or greater than half of the overall thickness of the assembled footwear's forefoot region of the sole system to provide cushioning for the forefoot region.

11. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

a single piece integrated arch-flex device (4) residing under at least a portion of the midsole (3) and having a medial arch support surface (54) in contact with the midsole (3) and providing support to the raised medial arch surface (31) of the midsole (3) to maintain the shape of the raised medial arch surface (31) in the unloaded state until sufficient weight is placed on the sole system (2) to tend to flatten the medial arch support surface (54), and a lateral arch surface (55) supporting a lateral arch surface 32 of the midsole (3), the integrated arch-flex device (4) having at least twice the hardness of the midsole (3); and an upper (8) configured to position a foot on the sole system (2) of the footwear (1), wherein the upper (8) includes a pair of strap rears (**8*b*) forwardly and readwardly adjustably attached to rearward sides of the sole system (2**) to allow adjustment for a desired fit.

12. The article of claim 11, wherein the midsole (3) is configured to peak under a medial arch of a wearer and tapers down behind the medial arch.

13. The footwear of claim 11, wherein the strap rears **8*b* are attached to slide blocks (7), the slide blocks (7) forwardly and rearwardly adjustably attached to the sole system (2**) to allow adjustment for a desired fit.

14. The footwear of claim 13, wherein the slide blocks (7) cooperating with the integrated arch-flex device (4) to allow adjusting and locking a position of the rear bases (**8*b***) to a desired fit.

15. The footwear of claim 11, wherein the upper (8) is a thong type upper, and strap fronts (**8*a*) of the thong type upper (8) are inserted into a forefoot toe loop slot (22) in the midsole (3), strap fronts (8*a*) secured by a toe loop stabilizer (130) reaching vertically over a portion of the strap fronts (8*a*), the toe loop stabilizer (130) also inserted down through the forefoot toe loop slot (22**).

16. The footwear of claim 15, wherein toe loop stabilizer (130) includes a toe post base (126) residing in a recess under the outsole 5, the toe post bases (126) includes cooperating "C" shaped openings allowing the toe post bases (126) of a pair of the footwear (1) to interconnect.

17. The footwear of claim 1, wherein the footwear defines a medial arch opening (184) below the raised medial arch surface (31) and a lateral arch opening (182) opposite to the medial arch opening (184), the medial arch opening (184) greater than the lateral arch opening (182), wherein flattening of the medial arch opening (184) and lateral arch opening (182) when weight is applied to the footwear (3) is coupled to a pivoting motion of the forefoot region with respect to the mid foot region of the footwear (3).

18. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

an integrated arch-flex device (4) residing under at least a portion of the midsole (3) and having a medial arch support surface (54) providing support to the raised medial arch surface (31) of the midsole (3) to maintain the shape of the raised medial arch surface (31) in the unloaded state until sufficient weight is placed on the sole system (2) to tend to flatten the medial arch support surface (54), the integrated arch-flex device (4) having at least twice the hardness of the midsole (3), the integrated arch-flex device (4) supporting the midsole (3) to resist pronatory motions of the foot;

an outsole (5) residing under the midsole and sandwiching the arch flex device (4) between the midsole 3 and the outsole (5), and having a bottom medial arch surface (83) under the medial arch support surface (54), the outsole (5) engaging the ground and responding to flexion motions of the foot; and a secondary arch-flex device (6) attached to the bottom of the outsole (5) and further supporting the midsole (3) to resist the pronatory motions of the foot; and an upper (8) configured to position a foot on the sole system (2) of the footwear (1), wherein the footwear defines a medial arch opening (184) below the raised medial arch surface (31) and a lateral arch opening (182) opposite to the medial arch opening (184), the medial arch opening (184) greater than the lateral arch opening (182), wherein flattening of the medial arch opening (184) and lateral arch opening (182) when weight is applied to the footwear (3) is coupled to a pivoting motion of the forefoot region with respect to the mid foot region of the footwear (3).

19. An article of footwear (1) comprising:

a sole system (2) having a general outline of a foot and comprising:

a midsole (3) having the same general outline of the foot, the midsole (3) in an unloaded state having a top surface having a natural contour of a bottom of a foot in a relaxed state, the midsole including a raised medial arch surface (31) providing an even contact and support to a medial arch area of the foot;

an integrated arch-flex device (4) residing under at least a portion of the midsole (3) and having a medial arch support surface (54) providing support to the raised medial arch surface (31) of the midsole (3) to maintain the shape of the raised medial arch surface (31) in the unloaded state until sufficient weight is placed on the sole system (2) to tend to flatten the medial arch support surface (54), the integrated arch-flex device (4) having at least twice the hardness of the midsole (3), the integrated arch-flex device (4) supporting the midsole (3) to resist pronatory motions of the foot;

an outsole (5) residing under the midsole and sandwiching the arch flex device (4) between the midsole 3 and the outsole (5), and having a bottom medial arch surface (83) under the medial arch support surface (54), the outsole (5) engaging the ground and responding to flexion motions of the foot;

a secondary arch-flex device (6) attached to the bottom of the outsole (5) and further supporting the midsole (3) to resist the pronatory motions of the foot;

the midsole (3) including a heel block (28) extending downward from the bottom of a heel region of the midsole (3) and through the arch-flex device (4) and into the outsole (5) to provide cushioning in the heel region, the midsole heel block (28) is formed with material different from the midsole (3) to provide energy absorbing cushioning needed in the heel region;

blocks (61-63) formed on the bottom of the outsole (5) before and after the bottom medial arch surface (83), the blocks (61-63) contacting the ground plane (169), the blocks (61-63) pass through the secondary arch-flex device (6), and the secondary arch-flex device (6) further resists the spreading of the blocks (61-63), wherein pronatory motions of the foot is coupled to a separation of the blocks (61-63), and contact of blocks (61-63) with the ground plane (169) resists the separation of the blocks (61-63) to further resisting pronatory motions of the foot; and an upper (8) configured to position a foot on the sole system (2) of the footwear (1), wherein the footwear defines a medial arch opening (184) below the raised medial arch surface (31) and a lateral arch opening (182) opposite to the medial arch opening (184), the medial arch opening (184) greater than the lateral arch opening (182), wherein flattening of the medial arch opening (184) and lateral arch opening (182) when weight is applied to the footwear (3) is coupled to a pivoting motion of the forefoot region with respect to the mid foot region of the footwear (3).

20. The article of claim 1, wherein the midsole (3) has a smooth top surface and sides extending down from the top surface.

21. The article of claim 1, wherein support for the midsole (3) resides solely under the top surface of the midsole (3).

22. The article of claim 1, wherein the raised medial arch surface (31) of the midsole (3) is raised above a heel region (**3*b*) of the midsole (3**) in the relaxed state.

* * * * *